US007185925B2

(12) United States Patent
Courter et al.

(10) Patent No.: US 7,185,925 B2
(45) Date of Patent: Mar. 6, 2007

(54) MOTORIZED OVEN DOOR LOCK MECHANISM WITH PULL-IN CAPABILITIES

(75) Inventors: Harry I. Courter, Indianpolis, IN (US); Matthew L. Kemp, Indianpolis, IN (US); Tracy J. Talley, Indianpolis, IN (US)

(73) Assignee: Emerson Electric Co., St. Louis, MO (US)

( * ) Notice: Subject to any disclaimer, the term of this patent is extended or adjusted under 35 U.S.C. 154(b) by 298 days.

(21) Appl. No.: 10/877,151

(22) Filed: Jun. 25, 2004

(65) Prior Publication Data

US 2005/0284465 A1 Dec. 29, 2005

(51) Int. Cl.
*E05C 19/12* (2006.01)

(52) U.S. Cl. ..... 292/109; 292/DIG. 69; 292/201

(58) Field of Classification Search ..... 292/95, 292/109, 110, 111, DIG. 69, 201
See application file for complete search history.

(56) References Cited

U.S. PATENT DOCUMENTS 3,462,584 A 8/1969 Guy
3,569,670 A 3/1971 Eff
3,859,979 A 1/1975 Gilliom
3,875,372 A 4/1975 Gilliom
3,912,904 A 10/1975 Phifer
4,109,637 A 8/1978 Drouin
4,374,320 A 2/1983 Barnett
4,927,996 A * 5/1990 Genbauffe et al. ..... 219/413
5,309,051 A * 5/1994 Kobori ..... 310/49 R
5,677,581 A * 10/1997 Yoshida et al. ..... 310/49 R
6,302,098 B1 10/2001 Smith
6,698,418 B2 * 3/2004 Ramsey et al. ..... 126/197

* cited by examiner

*Primary Examiner*—Gary Estremsky
(74) *Attorney, Agent, or Firm*—Maginot, Moore & Beck, LLP

(57) ABSTRACT

A motorized door lock assembly for locking an oven door mounted on a range body in a closed position so as to close an oven compartment for purposes of cleaning the oven compartment is provided. The door lock assembly comprises a latch, a motor, a rotor arm and a linkage. The latch has a hook at one end for engaging the oven door and is mounted to the range body for rotation about a translatable pivot axis between an unlatched position wherein the hook does not inhibit movement of the oven door and a latched position wherein the hook does inhibit movement of the oven door. The latch is also mounted for reciprocal translation with the pivot axis between a non-pulled-in position wherein the latch does not pull against the oven door and a pulled-in position wherein the latch pulls against the oven door. The rotor arm is rotatably driven by the motor. The linkage extends generally from a back to a front of the range body above the oven compartment and is secured to the rotor arm at one end and secured to the latch at the other end. Upon rotation of the rotor arm by the motor, the linkage translates inducing rotation of the latch from the unlatched position to the latched position prior to translating the latch from the non-pulled-in to the pulled-in position.

20 Claims, 18 Drawing Sheets

MOTORIZED OVEN DOOR LOCK MECHANISM WITH PULL-IN CAPABILITIES

CROSS REFERENCE

Cross reference is made to co-pending U.S. patent application Ser. No. 10/877,145, entitled Oven Lock With Mechanical Actuation of Remotely Located Door Switch by Harry I. Courter, Matthew L. Kemp and Tracy J. Talley, which is assigned to the same assignee as the present invention, and which is filed concurrently herewith, the disclosure of which is hereby totally incorporated by reference in its entirety.

BACKGROUND AND SUMMARY

This invention relates generally to door locks for self-cleaning ovens and more particularly to door locks wherein heat sensitive components are positioned away from the oven compartment opening.

Conventional gas or electric ovens collect deposits from whatever is cooked therein. Modern ovens are designed to self-clean by using high heat to reduce these deposits to dust. This cleaning method is commonly known as pyrolytic cleaning. The high temperature used for pyrolytic cleaning poses a hazard if the oven door is opened during the cleaning cycle. To prevent this, an oven door lock is employed.

Many types of oven door locks have been provided that lock the oven door for a period sufficient to complete a pyrolytic cleaning cycle. Controls and timers are well known to facilitate locking the oven until the self-cleaning cycle is completed. Many of these door locks use electrical motors, electromechanical machines or manual manipulation of mechanisms to move a latch to a position in which the latch prevents the oven door from being opened during a self-cleaning cycle. Additionally, switches are used to indicate the state of the oven door, to enable the motor and to indicate whether the latch is securing the oven door against opening. Examples of such locks are disclosed in Eff, U.S. Pat. No. 3,569,670; Gilliom, U.S. Pat. No. 3,859,979; Drouin, U.S. Pat. No. 4,109,637; Barnett, U.S. Pat. No. 4,374,320; Genbauffe et al., U.S. Pat. No. 4,927,996 and Smith, U.S. Pat. No. 6,302,098.

Smith, U.S. Pat. No. 6,302,098 discloses an oven door latch assembly with motors and switches located in a rearward position and a latch mounted for pivotal and longitudinal movement between an unlatched position, a latched position and a latched and sealed position. Smith uses a bias spring to bias the latch toward the unlatched position.

The switches and motors used in self-cleaning ovens are heat sensitive. Many of the disclosed oven locks place these switches and motors in areas adjacent the oven compartment opening at the front of the oven frame. When the motors and switches are located in such high heat areas, it is necessary to utilize heat tolerant switches and motors to reduce oven lock failures.

The disclosed oven lock mechanism positions the switches and motors for actuating and controlling the oven lock in the rear of the oven away from the high heat adjacent the oven compartment opening. The disclosed lock eliminates the spring biasing the latch in the unlatched position.

Thus, a less heat tolerant motor is used to move the latch between an unlatched position and a latched position during a cleaning cycle. Additionally, less heat tolerant switches are utilized to indicate the state of the door and the latch. Also, relatively inexpensive sheet metal and metal rods are substituted for bias springs to cause the latch to move to a latched position when a self-cleaning cycle has been initiated and to an unlatched position when the cleaning cycle has not been actuated or has been completed.

According to one aspect of the disclosure, an oven lock mechanism for locking a door of a self-cleaning oven in a closed position is provided. The oven has a front and a rear and the oven door is mounted on a frame surrounding an opening of an oven compartment and is movable between an open and a closed position. The oven lock mechanism comprising a mounting plate, a latch, a pin, a motor, a rotor arm and a rod. The mounting plate is supported above the oven compartment and is formed to have a channel therein formed about an axis extending laterally relative to the front of the oven. The latch is adapted to engage the oven door and is movable between a first position in which the oven door may be opened and a second position in which the oven door may not be opened. The pin extends from a fixed position on the latch through the channel and is received for movement along the axis of the channel. The pin is configured to rotate within the channel facilitating rotation of the latch relative to the mounting plate from the first position to the second position. The rotor arm is rotatably driven by the motor. The rod is secured to the rotor arm at a first end and secured to the latch at a second end. The rod acts to convert rotary movement of the rotor arm into rotational and translational movement of the latch and acts to guide the latch toward the second position during translational movement of the latch.

According to another aspect of the disclosure, a motorized door lock assembly for locking an oven door mounted on a range body in a closed position so as to close an oven compartment for purposes of cleaning the oven compartment is provided. The door lock assembly comprises a latch, a motor, a rotor arm and a linkage. The latch has a hook at one end for engaging the oven door and is mounted to the range body for rotation about a translatable pivot axis between an unlatched position wherein the hook does not inhibit movement of the oven door and a latched position wherein the hook does inhibit movement of the oven door. The latch is also mounted for reciprocal translation with the pivot axis between a non-pulled-in position wherein the latch does not pull against the oven door and a pulled-in position wherein the latch pulls against the oven door. The rotor arm is rotatably driven by the motor. The linkage extends generally from a back to a front of the range body above the oven compartment and is secured to the rotor arm at one end and secured to the latch at the other end. Upon rotation of the rotor arm by the motor, the linkage translates inducing rotation of the latch from the unlatched position to the latched position prior to translating the latch from the non-pulled-in to the pulled-in position.

According to yet another aspect of the disclosure, an oven lock mechanism for use with an oven having a door at the front of the oven and a frame surrounding a cooking chamber having an opening at the front of the oven and a rear wall adjacent to a rear of the oven is provided. The front opening of the cooking chamber is selectively closed by engagement of the door with the frame. The lock mechanism comprises a pivot pin, a mounting plate, a latch, an electromechanical actuator and a linkage. The pivot pin has a pivot axis extending therethrough. The mounting plate is mounted to the frame and extends from the front to beyond the rear wall of the oven chamber. The mounting plate is formed to include a pivot pin guide configured to guide reciprocal movement of the pivot pin received therein forwardly and rearwardly with respect to the mounting plate. The latch is mounted to the pivot pin for movement about the pivot axis and is rotatable about the pivot axis between an unlatched position and latched position. The latch is mounted to the mounting plate for reciprocal movement with the pivot pin between a pulled-in position and a non-pulled-in position. The electromechanical actuator is mounted to the mounting plate and assumes a first state and a second state. The linkage is coupled between the latch and the actuator to move the latch from the unlatched and not pulled-in position when the actuator is in the first state to the latched and pulled-in position when the actuator is in the second state. The linkage induces rotation of the latch from the unlatched state to the latched state prior to inducing reciprocal movement of the latch.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The illustrative devices will be described hereinafter with reference to the attached drawings which are given as non-limiting examples only, in which.

DETAILED DESCRIPTION OF THE ILLUSTRATED EMBODIMENT

Figure 1:
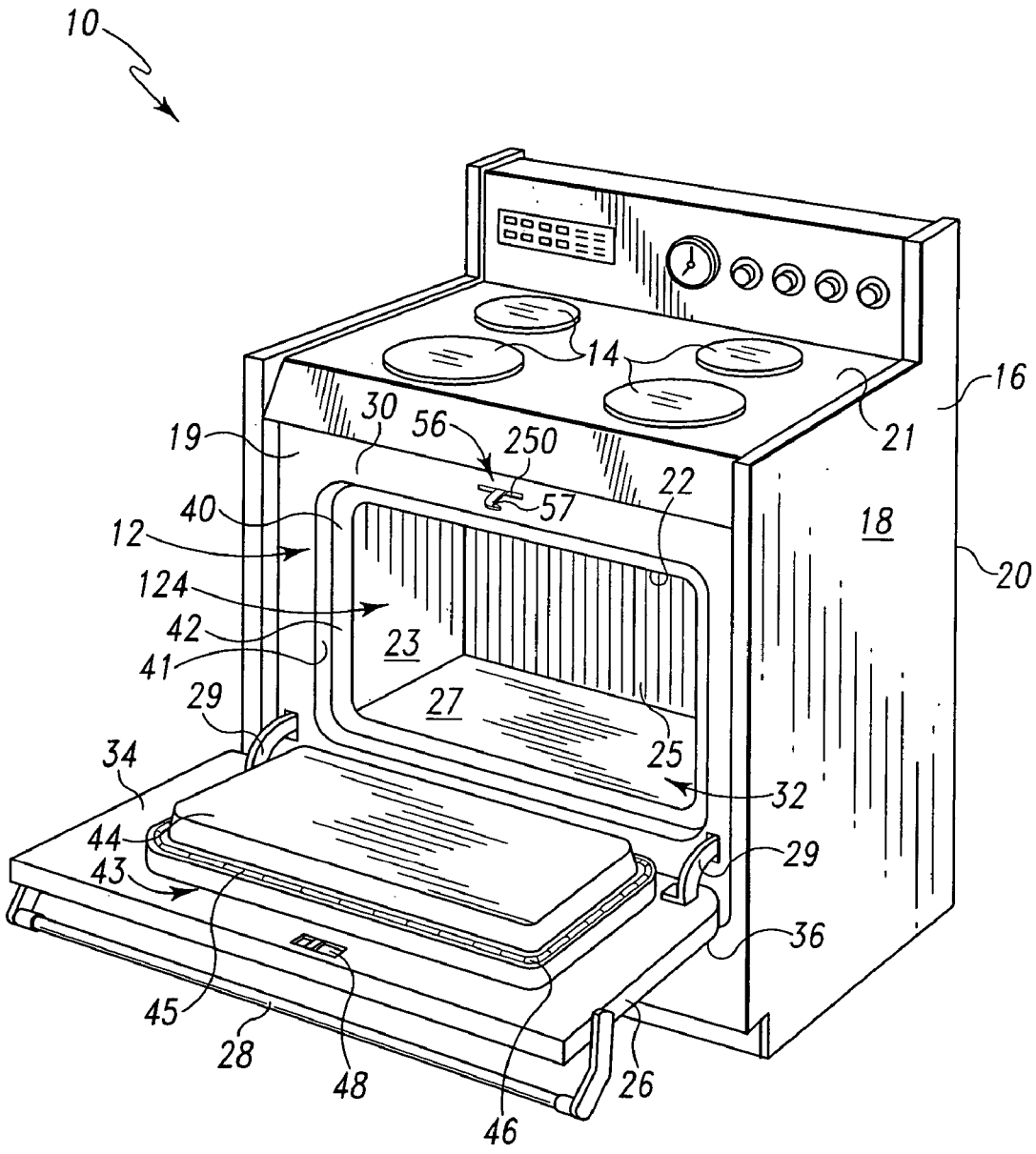
FIG. 1 is a perspective view of a range including a self-cleaning oven having an oven compartment configured to be closed by an oven door shown in an open position to reveal a portion of a latch of the oven lock mechanism extending forwardly beyond the oven frame.
Figure 2:
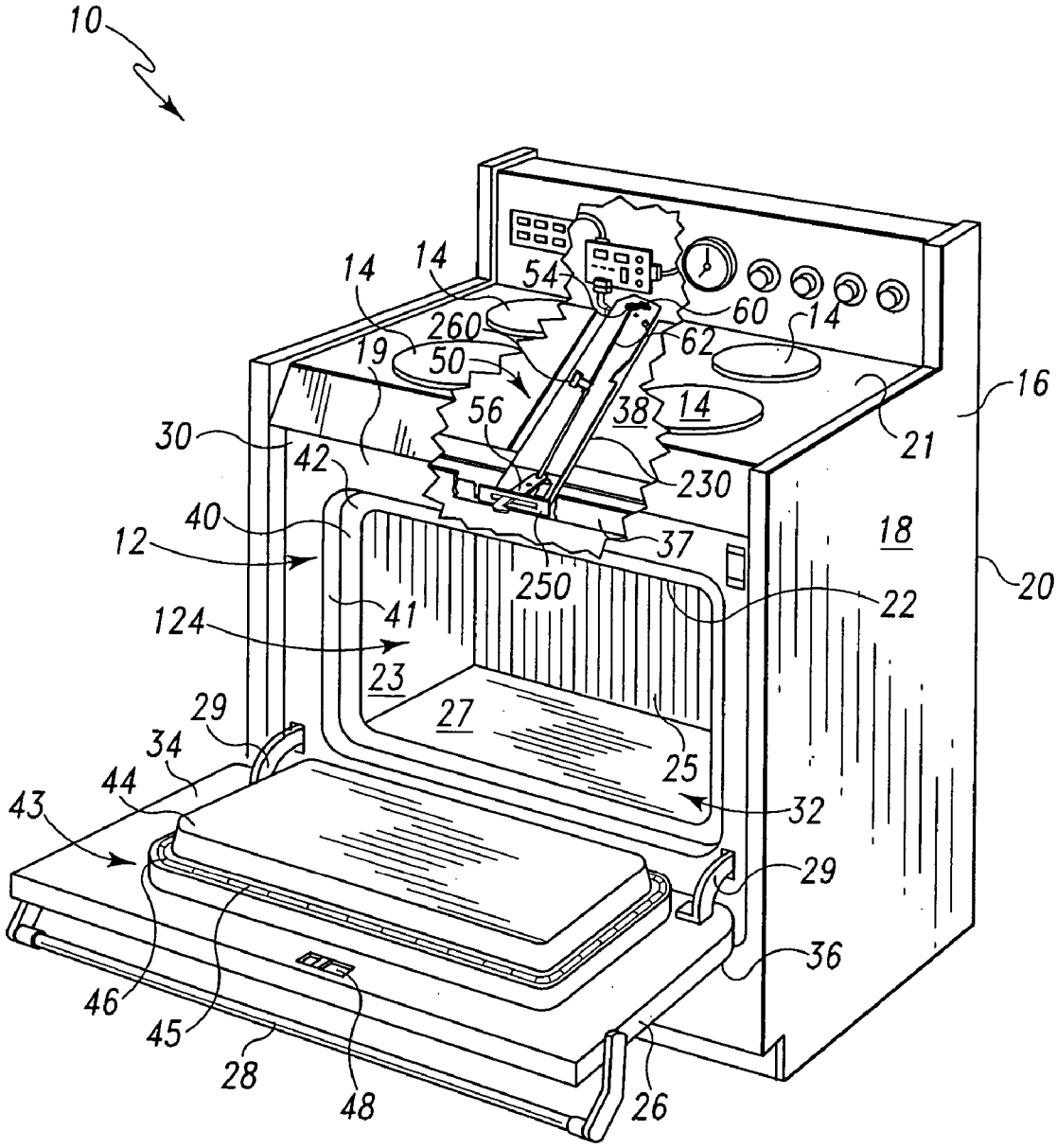
FIG. 2 is a perspective view similar to FIG. 1 with parts of the oven broken away to reveal the mounting plate, latch, linkage, cam and switch of the oven lock mechanism and revealing that the latch is mounted near the front of the oven while the motor driving the cam and the switch are located at the rear of the oven with the linkage extending between the cam and the latch to couple the two.
Figure 3:
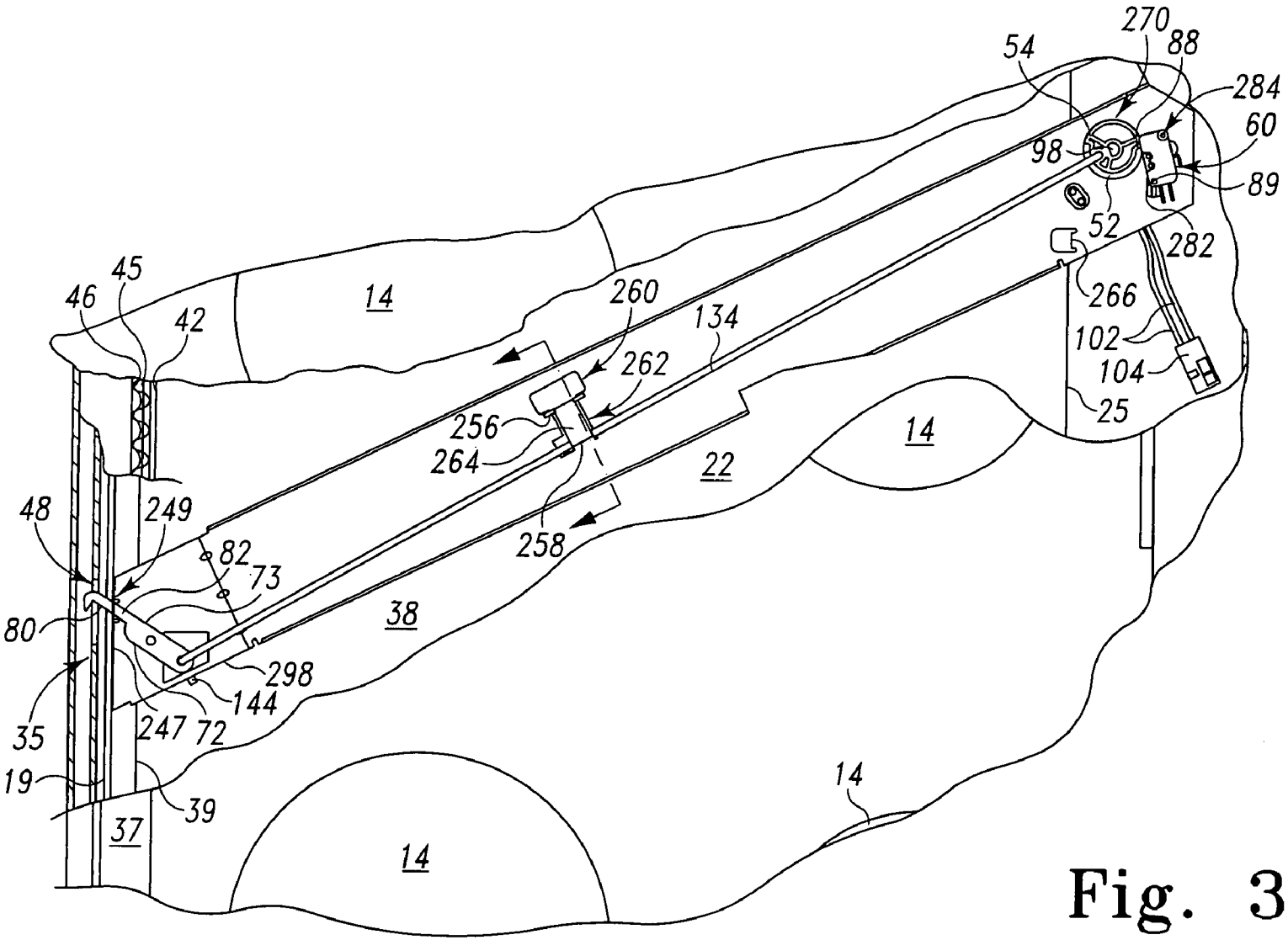
FIG. 3 is a top view with parts broken away of the range and oven lock mechanism of FIG. 2 showing the oven door closed and the oven lock mechanism in the unlatched position.

The oven lock mechanisms 50, 350, 650 disclosed herein each include a latch 56, 656 that is mounted for pivoting between a latched position and an unlatched position. In the unlatched position movement of the oven door 26 between an open and a closed position is not inhibited. In the latched position, movement of the oven door 26 from the closed position to an opened position is inhibited by engagement of a component of the door 26 by the latch 56, 656. FIGS. 1–3 show the position of the latch 56, 656 with respect to the front frame wall 19 of the oven 12.

As shown, for example, in FIGS. 2–5, 7–8, a motor 52 mounted at the rear of the oven 12 rotates a cam 54 that is coupled by a rod 62 to the latch 56, 656. The latch 56, 656 is mounted for pivotal movement relative to the frame of the oven 12. Thus, in each of the illustrated embodiments of the oven lock mechanism 50, 350, 650 the temperature sensitive motor 52 and switch 60 are located at the rear of the oven 12 away from the high temperature region adjacent to the opening of the oven compartment 24. As the heat tolerance of a motor or switch increases, the cost of the switch or motor increases. Motors and switches capable of tolerating the temperatures commonly present at the rear of an oven during the self-cleaning cycle are substantially cheaper than motors and switches capable of tolerating the temperatures experienced at the front of the oven 12 adjacent the oven opening 32. Thus, each of the illustrated embodiments facilitates using lower cost components for implementing the locking mechanism 50, 350, 650.

The illustrated embodiments of the oven lock mechanism 50, 350, 650 move all of the more heat sensitive components utilized in an oven lock mechanism to the back of the oven 12 away from the high temperatures often experienced at the front of the oven 12 near the interface of the door 26 and the abutment surface of the front wall 19 of the frame 30. In each embodiment, a long rod or linkage 62 couples the latch 56, 656 to a cam 54 driven by the motor 52. In each illustrated embodiment, the latch 56, 656 is located in the high temperature region at the front of the oven 12 to be able to interact with the oven door 26.

The motor and gear box (hereinafter referred to as motor 52), cam 54 and rod 62 for converting rotational movement of the motor 52 to reciprocal movement of the rod 62, is the same in each illustrated embodiment of the oven lock mechanism 50, 350, 650. Also, the rear portion 234 of the mounting plate 230 is essentially the same in each embodiment of the oven lock mechanism 50, 350, 650. However, the configuration of and manner of operation of the latch 56, 656 differs between the first and second embodiments 50, 350 and the third embodiment 650. The first and second embodiments 50, 350 provide a latch 56 that pivots between latched and unlatched positions and when in the latched position can translate rearwardly to pull-in the oven door 26. The third embodiment 650 provides a latch 656 that pivots between latched and unlatched positions and when in the latched position can translate rearwardly to pull-in the oven door 26 and also stabilizes motor torque when components of the lock mechanism or the range experience tolerance build-up.

It is within the scope of the disclosure to use the oven lock mechanism 50, 350, 650 disclosed herein in combination with motor-enabling switches and switch actuators that only enable the motor 52 once the oven door 26 is closed. Such a switch actuator and motor-enabling switch are disclosed in commonly assigned co-pending U.S. patent application Ser. No. 10/877,145, entitled Oven Lock With Mechanical Actuation of Remotely Located Door Switch by Harry I. Courter, Matthew L. Kemp and Tracy J. Talley, the disclosure of which is hereby expressly incorporated herein by this reference.

As shown, for example, in FIGS. 1–2, a self-standing range 10 includes a pyrolytic self-cleaning oven 12 on top of which is a cook top 21 including a plurality of burners 14. The range 10 includes a body 16 having a pair of side walls 18, a front wall 19, a back wall 20 and the cook top 21. Spaced a fixed distance below the top 21 of the range body 16 is an oven top wall 22. An oven compartment or cavity 24 is defined by the oven cavity top wall 22, oven cavity side walls 23, an oven cavity back wall 25 and an oven cavity bottom wall 27. Oven top wall 22, oven side walls 23, oven back wall 25, oven bottom wall 27 and front wall 19 of body 16 define an oven frame 30. While not shown, one or more heating elements are typically located within the oven cavity 24.

Figure 4:
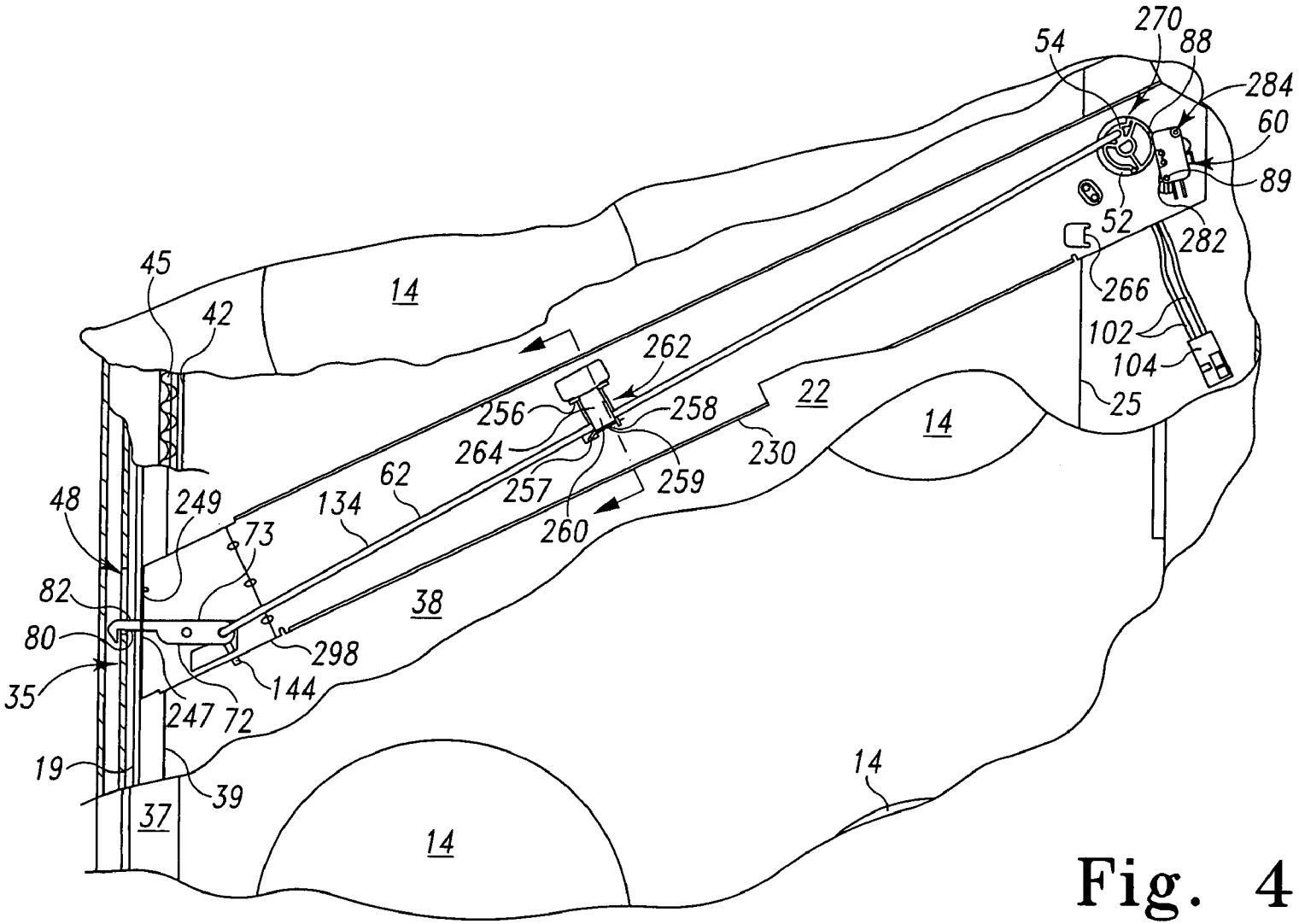
FIG. 4 is a top view with parts broken away of the range and oven lock mechanism of FIG. 3 showing the oven door closed and the oven lock mechanism in the latched position.
Figure 5:
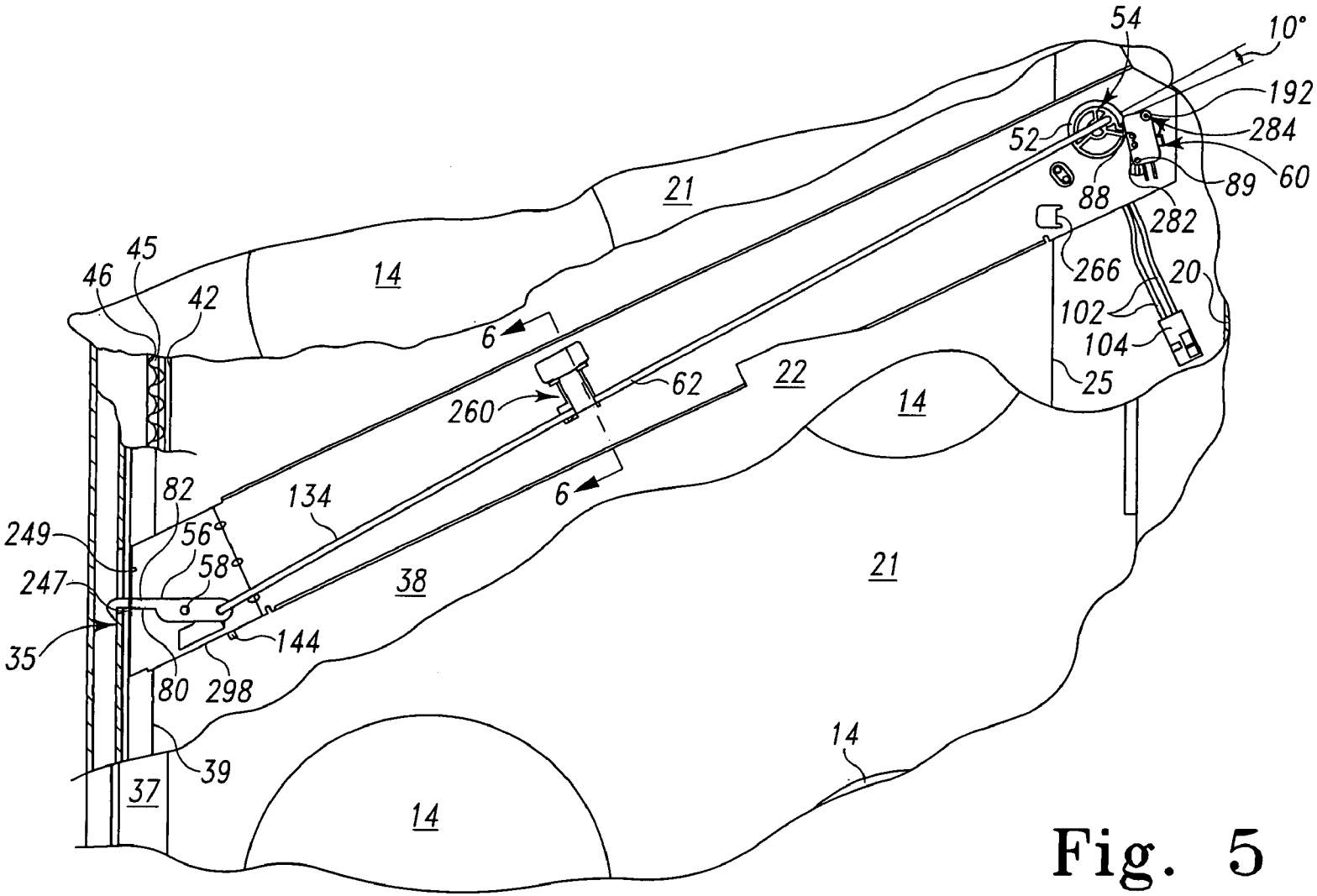
FIG. 5 is a top view with parts broken away of the range and oven lock mechanism of FIG. 4 showing the oven door closed and the oven lock mechanism in the latched and pulled-in position.
Figure 6:
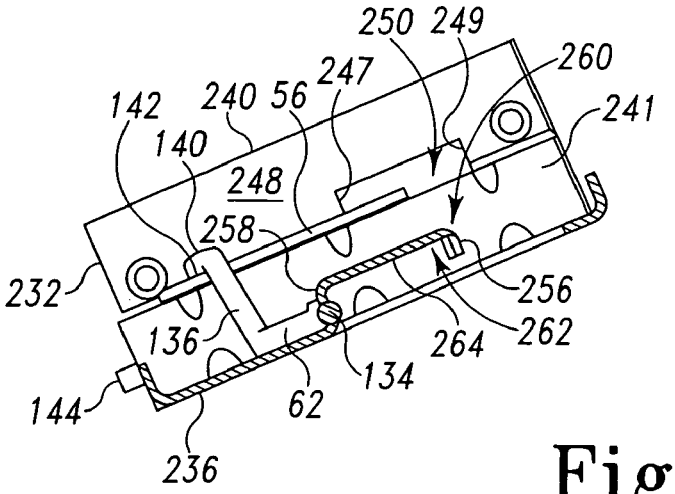
FIG. 6 is a view taken along line 6—6 of FIG. 5 showing the rod received in the directional positioning guide.
Figure 7:
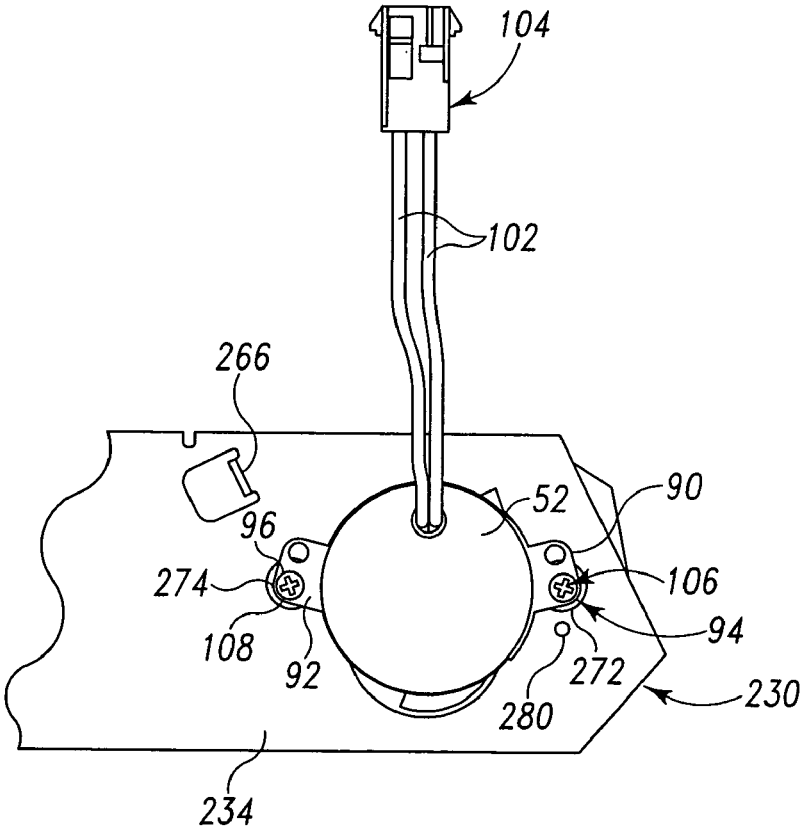
FIG. 7 is a bottom view of the rear portion of the oven lock mechanism of FIG. 3 showing the motor mounted to the bottom surface of the mounting plate and showing a mounting flange extending downwardly from the bottom surface of the mounting plate for use in coupling the mounting plate to the outside rear wall of the oven compartment.
Figure 9:
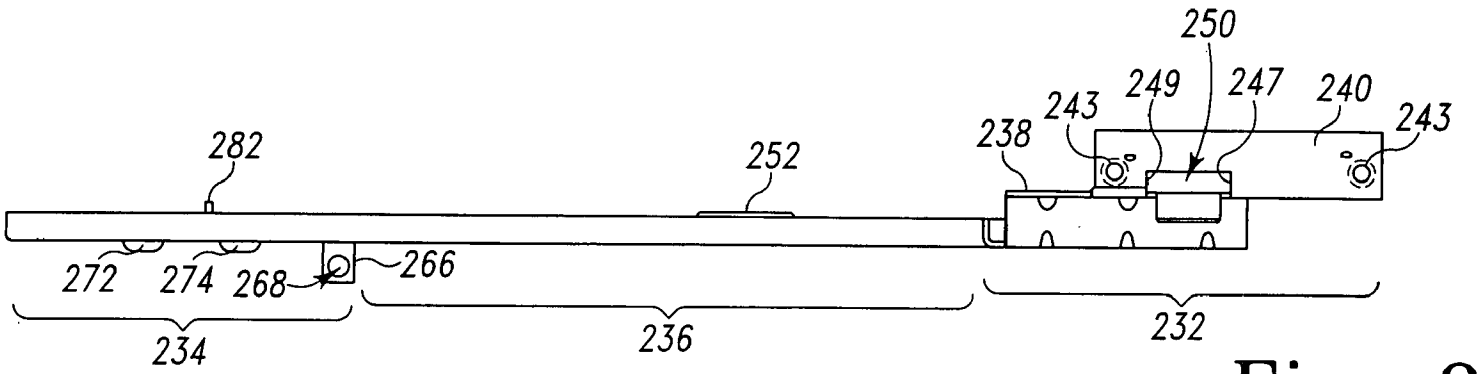
FIG. 9 is a front elevation view of the mounting plate of oven latch mechanism.
Figure 8:
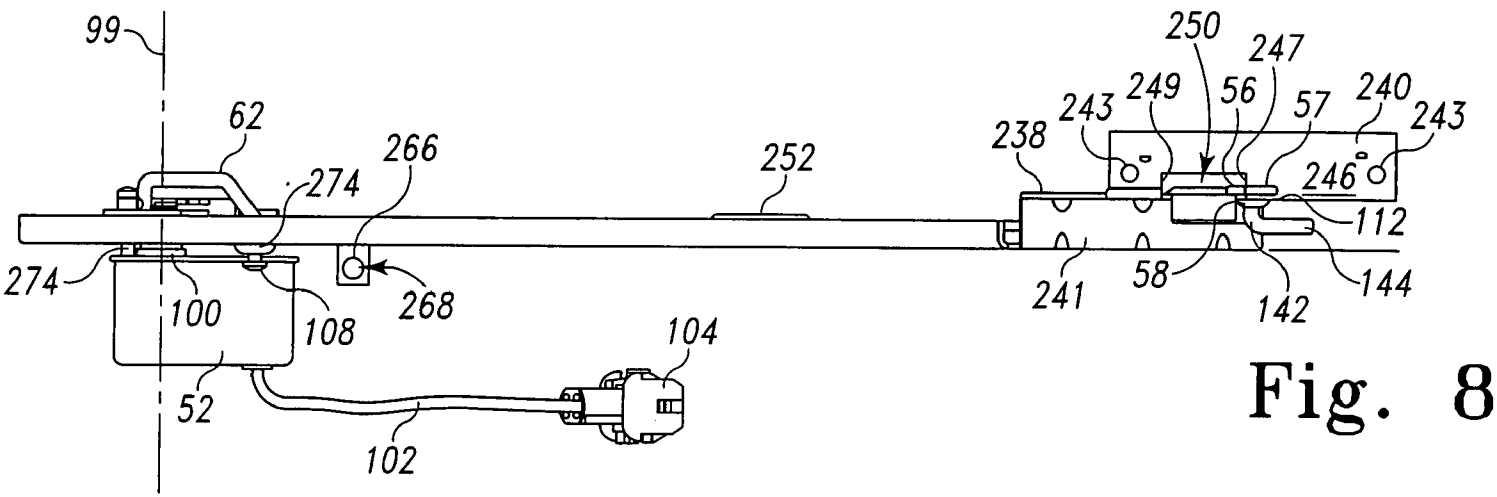
FIG. 8 is a front elevation view of the oven lock mechanism of FIG. 3.
Figures 10, 11:
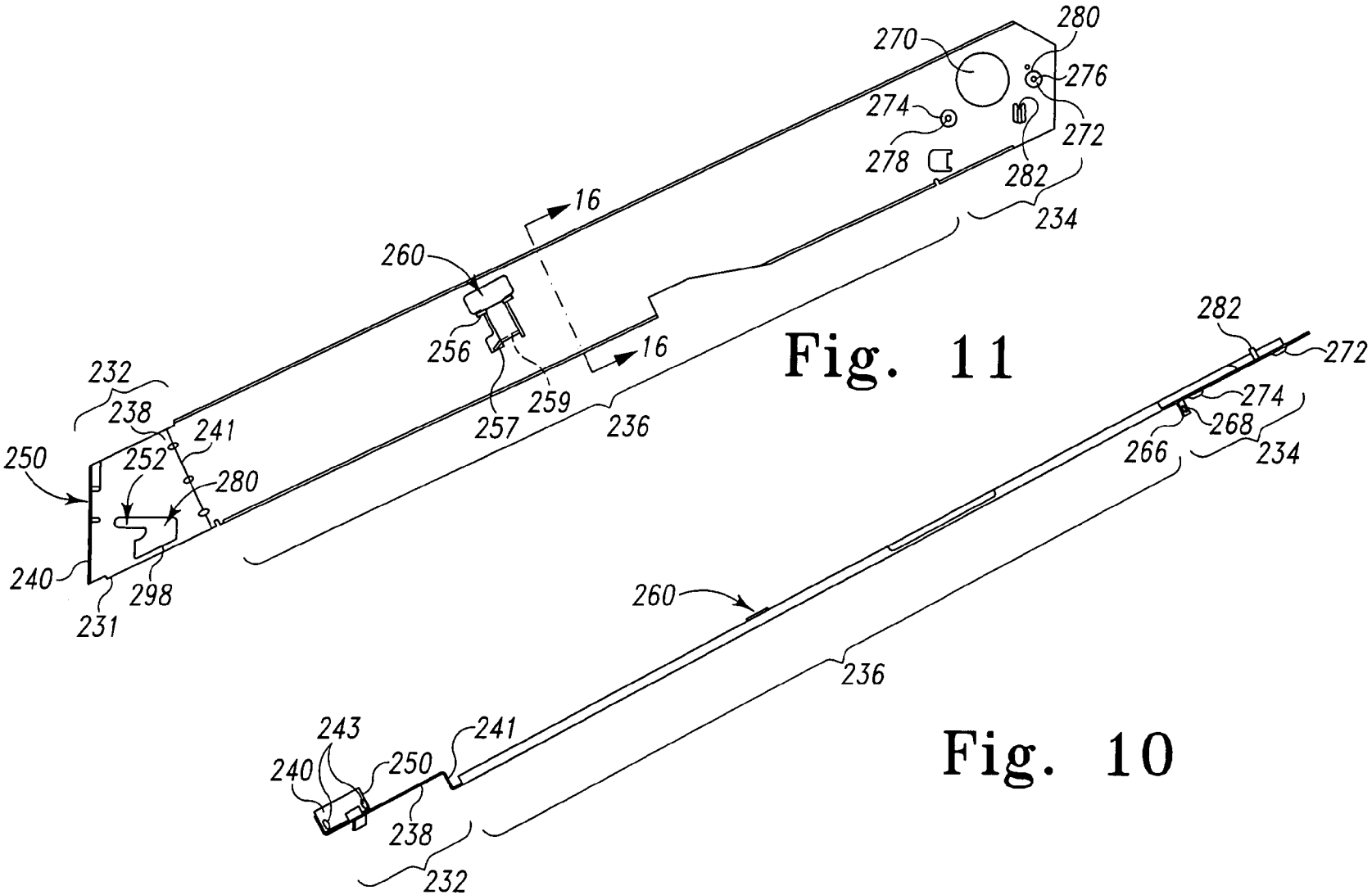
FIG. 10 is a side elevation of the mounting plate of FIG. 9.
FIG. 11 is a top plan view of the mounting plate of FIG. 10.

An oven door 26 having a handle 28 is hingedly mounted at its bottom with hinges 29 to the front wall 19 of the range body 16 below the front opening of the oven cavity 24. The oven door 26 opens about a horizontal axis to move between an open position as shown in FIGS. 1, 2 and a closed position as shown in FIGS. 3–5. The oven door 26 includes a back wall 34 and a front wall 36 spaced apart from the back wall 34. The area between the front wall 36 and the back wall 34 is often filled with insulation in regions covering the oven opening 32 and left as a void in other regions. While not shown, oven door 26 includes a plurality of spring assemblies, which as the oven door 26 approaches the closed position tend to urge the oven door 26 closed.

In the illustrated embodiment, the front wall 19 of the frame 30 of the oven 12 is formed to include a recessed region 40 surrounding the front opening 32 of the oven cavity 24. Recessed region 40 includes a rearwardly extending side wall 41 and a forwardly facing wall 42 surrounding the opening 32 of the oven cavity 24. The back wall 34 of the oven door 26 includes a similarly configured protrusion 43. A plug portion 44 of the protrusion 43 extends into the oven cavity 24 slightly when the oven door 26 is closed. A seal or gasket 45 is mounted on an peripheral wall 46 surrounding the plug portion 44 of the protrusion 43, as shown, in FIGS. 1 and 2. When the oven door 26 is closed, the seal 45 engages the forwardly facing wall 42 of the recessed region 40 of the oven frame 30. When the oven door 26 is locked during a self cleaning cycle, each disclosed embodiment of oven door lock mechanism 50, 350, 650 compresses the seal 45 between the forwardly facing wall 42 of the recessed region 40 and the peripheral wall 46 surrounding the plug portion 44 of the protrusion 43.

As shown, for example, in FIG. 1, the motorized oven door lock mechanism 50 is mounted at the top of the frame 30 of the oven 12 just under the cook top 21 out of sight. Portions of the motorized oven lock mechanism 50 are mounted at the front of the frame 30 adjacent the oven chamber opening 32 and other portions of the oven mechanism 50 are mounted toward the rear wall 25 of the oven frame 30 away from the oven compartment opening 32. Those skilled in the art will recognize that the temperatures experienced by components mounted in the rear location are substantially lower than those experienced by components mounted adjacent the oven compartment opening 32.

As shown, for example, in FIGS. 3–5 and 7–8, the motor 52 includes mounting flanges 90, 92 formed to include mounting holes 94, 96, a D-shaped shaft 98, a shaft bearing 100, lead wires 102 and an electrical coupling 104. Motor 52 is illustratively a synchronous induction AC high torque ODL class "F" motor. Motor 52 operates at 3 RPM in response to a 120 VAC, 60 Hz signal. Illustratively, motor 52 has a 130 IN-OZ (0.922 Nm) minimum start and stall torque at 3 RPM over the operating range of 90V to 130V. An appropriate motor 52 is available from Ningbo Ming Jong as part no. 203-65731-01. Illustratively, motor 52 includes two twenty-two guage lead wires 102 coupled to the connector 104 adapted for coupling to the drive circuitry (not shown) of the motor 52. In the illustrated embodiment, connector 104 is an AMP connector available as Part No. 1-480699-0.

It is within the scope of the disclosure for other motors or electromechanical actuators and connectors to be used to rotate cam 54 to induce latch 56 to move between the unlatched, latched and latched and pulled-in positions.

Mounting hole 94 in mounting flange 90 is sized to receive a fastener 106, such as a screw, rivet or other fastener, which also extends through a motor mounting hole 276 formed in the frusto-conical mounting boss 272 extending downwardly from the bottom surface 244 of the rear portion 234 of the mounting plate 230. Mounting hole 96 in mounting flange 92 is sized to receive a fastener 108, such as a screw, rivet or other fastener. The fastener 108 also extends through a motor mounting hole 278 formed in the frusto-conical mounting boss 274 extending downwardly from the bottom surface 244 of the rear portion 234 of the mounting plate 230. When the motor 52 is mounted to the bottom surface 244 of the rear portion 234 of the mounting plate 230, the motor driven D-shaped shaft 98 and the shaft bearing 100 are centered with respect to the motor shaft-receiving aperture 270 in the mounting plate 230. The cam 54 is mounted on the D-shaped shaft 98 with the D-shaped shaft 98 being received in the D-shaped motor shaft-mounting bore 170. Thus, rotation of motor 52 drives the shaft 98 and the cam 54 attached thereto.

The switch 60 used in the oven lock mechanism 50 is not as heat resistant as the switches used in the oven lock mechanisms that locate the switches adjacent to the oven compartment opening 32 at the front of the oven 12. Thus switch 60 may be substantially cheaper than switches used in other oven lock mechanisms for self-cleaning ovens. The ability to use cheaper less heat tolerant switches facilitates fabrication of inexpensive oven lock mechanisms. Oven lock mechanisms 50, 350, 650 locate the switch 60 in a location where less heat is typically present in an oven 12.

While the more heat sensitive components are mounted to the back of the oven 12, non-heat sensitive components are mounted at the front of the oven 12 near the interface of the door 26 and the frame 30. A long rod or linkage 62 couples the latch 56 to the cam 54. The latch 56 is located in the high temperature region at the front of the oven 12 to be able to retain the oven door 26 in a locked position when the oven 12 is placed in a self-cleaning mode of operation. The switch 60 activated by the cam is temperature sensitive and thus is located in the lower temperature rear of the oven 12.

The oven lock mechanism 50 utilizes a cam 54 coupled by the rod 62 to the latch 56. The rotation of the cam 54 by the motor 52 removes any surplus slack or mechanical play from the mechanical linkage (i.e. the cam 54, the rotary push rod 62, and the latch 56) and positions the latch 56 in a latching position (FIG. 4) prior to pulling the latch 56 inwardly against the seal 45 to seal the oven compartment 24 for the self-cleaning cycle (FIG. 5).

As shown, for example, in FIGS. 2–29, the motorized oven lock mechanism 50 includes a latch 56, a rod 62, a latch pivot pin 58, a motor 52, a cam 54, a cam-actuated switch 60 and a mounting plate or bracket 230. Mounting plate or bracket 230 is formed to include a directional positioning guide flange or directional positioner 260 through which the rod 62 passes to induce the rod 62 to urge the latch 56 toward the unlatched position as the motor 52 rotates the cam 54 toward its unlatched position.

The latch 56 is pivotally mounted to the pivot pin 58. The pivot pin 58 is mounted for movement relative to the mounting plate 230. In the illustrated embodiment, the mounting plate 230 is formed to include a pivot pin channel 252 sized to receive the pivot pin 58 for reciprocal movement therein. The latch end 130 of the rod 62 is coupled to the latch 56 mounted to the front portion 232 of the mounting plate 230. All of these components in the illustrated oven lock 50 are made of metal, such as polished nickel, and are very heat tolerant. The hook 57 of the latch 56 is exposed forward of the front wall 19 of the frame 30 that interfaces with the inside wall 34 of the oven door 26. When the oven door 26 is closed, the forward facing wall 42 of the recessed area 40 engages the seal 45 on the peripheral wall 46 of the door 26, as shown, for example, in FIGS. 3–6.

The cam 54 is coupled to the shaft 98 of the motor 52. Rotational movement of the shaft 98 of motor 52 is converted by cam 54 and rod 62 to reciprocal movement of the latch 56. When a self-cleaning cycle is selected, typically by a user actuating a switch on the oven control panel, a circuit is closed driving the motor 52 to rotate the cam 54. The cam 54 rotates to a latched position, as shown, for example, in FIG. 4 and then to a latched and pulled-in position, as shown, for example, in FIG. 5. During rotation of the cam 54 from the unlatched position toward the latched and pulled-in position, the follower surface 166 of the lobe 160 of the cam 54 engages the contact button 88 of the cam-actuated switch 60. When the cam 54 reaches the locked and pulled in position, the trailing wall of the follower surface 166 of the lobe 160 of the cam 54 is positioned so that the contact button 88 of the cam actuated switch 60 no longer engages the follower surface 166 of the cam 54. Thus, the cam-actuated switch 60 experiences a change of state generating a signal utilized to control the proper position of the cam 54 so that the rod 62 coupled thereto causes the latch 56 to be positioned in the latched and pulled-in position. Cam-actuated switch 60 signals to the electronic package a change in state of the cam 54 and latch 56 so that the electronic package can initiate the cleaning cycle timer.

As shown, for example, in FIGS. 3–6, in oven lock mechanism 50, the latch 56 is not advanced into a latched position every time the door 26 is closed, but is so advanced only when the oven 12 is placed in a self-cleaning mode of operation by a user. When a user does place the oven 12 in the self-cleaning mode, an oven controller actuates the motor 52 to drive the cam 54 to the latched and pulled-in position. As discussed more fully below, the illustrated cam 54 is configured so that the trailing wall 164 of the follower surface 166 is displaced angularly relative to the rod-receiving hole 176 so that the rod-receiving hole is ten degrees before top dead center when the cam 54 is in the latched and pulled-in position. When the cam 54 is placed in such latched and pulled-in position, any attempt to open the oven door 26 will be unsuccessful since detent force of the motor 52, the cam 54 and the rod 62 cooperate to prevent the latch 56 from pivoting back to its unlatched position. Once the self-cleaning cycle is completed, the oven controller actuates the motor 52 to drive the cam 54 back to the unlatched position. When placed in such unlatched position, an attempt to open the oven door 26 is successful since the cam 54 has positioned the latch 56 in its unlatched position.

More particularly, the front portion 232 of the mounting plate 230 of the oven lock mechanism 50 is mounted to the top front of the oven frame 30. The front portion 232 of the mounting plate 230 of the oven lock mechanism 50 is positioned relative to the frame 30 so that the hook 57 of the latch 56 extends forwardly beyond the front wall 19 of the oven frame 30 when the oven door 26 is opened. This is to permit the inner wall 34 of the oven door 26 to be engaged by the hook 57 of the latch 56 when a self-cleaning cycle is initiated and the latch 56 is rotated into its latching position.

As shown, for example, in FIGS. 2–6, 8, the latch 56 is mounted to the front portion 232 of the mounting plate 230 for pivotal movement about the pivot axis 69 for movement between the latched position and an unlatched position. The latch 56 is coupled by the rod 62 to the cam 54. The cam 54 is mounted to the motor 52 mounted to the rear portion 234 of the mounting plate 230. Motor 52 rotates cam 54 relative to the mounting plate 230 about an axis of rotation 99 extending through the shaft 98 of the motor 52. As the cam 54 rotates to the latched and pulled-in position, rotation of the cam 54 is transferred through the rod 62 to the latch 56 which pulls against the oven door 26 to "pull-in" the oven door 26. Pulling-in involves taking up any mechanical slack from tolerance build up between the parts and compressing the seal 45 between the peripheral wall 46 of the door 26 and the forward facing wall 42 of the recessed region 40 of the frame 30. The intermediate latched position, is shown, for example, in FIG. 4 and the latched and pulled-in position is shown, for example, in FIG. 5.

The rear portion 234 of the mounting plate 230 is rigidly mounted to the top rear of the oven frame 30 as shown, for example, in FIGS. 2–5. The rear portion 234 of the mounting plate 230 is formed to include a mounting flange 266 extending downwardly from the bottom surface of the mounting plate 230. Mounting flange 266 is formed to include a mounting hole 268. A fastener (not shown) extends through mounting hole 268 and into the back wall 25 of the oven 12 to secure mounting plate 230 to oven frame 30. As shown, for example, in FIGS. 2–5, the remainder of the rear portion 234 of the mounting plate 230 extends beyond the rear wall 25 of the oven compartment 24 and is suspended within a void between the rear wall 25 of the oven compartment 24 and the rear wall 20 of the range 10.

The motor 52 is mounted to the rear portion 234 of the mounting plate 230 so that its shaft 98 extends through a motor shaft-receiving aperture 270 formed in the rear portion 234 of the mounting plate 230. The cam 54 is mounted to the shaft 98 so that the lobe 160 of cam 54 is positioned to engage the contact 88 of the cam-actuated switch 60 upon rotation of the motor 52. When the oven door 26 is open (FIG. 2), or when the door 26 is closed and a cleaning cycle has not been initiated (FIG. 3), the lobe 160 of the cam 54 is positioned such that the portion adjacent the leading wall 162 engages the contact 88 of cam-actuated switch 60.

Clockwise rotation of the cam 54 from the unlatched position toward the latched position induces counter-clockwise (as seen from the top) rotation of the latch 56 about the pivot pin 58. The counter-clockwise rotation of the latch 56 eventually stops and further rotation of the cam 54 causes the latch 56 to translate rearwardly guided by pivot pin 58 sliding within guide channel 352. Counter-clockwise rotation of the latch 56 causes the hook 57 to be pivoted within a slot 48 in the door 26 of the oven 12 to a position in which the engaging wall 74 of the hook 57 is adjacent to the inner surface 35 of the back wall 34 of the oven door 26. In this position, the latch 56 would prohibit outward movement of the door 26.

Not only does the disclosed oven lock mechanism 50 induce the latch 56 to rotate from an unlatched position to a latched position after a cleaning cycle initiation signal has been received, but it also moves the latch 56 into a latched and pulled-in position in which the gasket or seal 45 disposed between the oven door 26 and the frame 30 is compressed as the door 26 is pulled into a more snug engagement with the frame 30. Clockwise rotation of the cam 54 causes the rod 62 to induce the latch to transfer rearwardly guided by the guide channel 252. During this rearward translation, the engaging wall 74 of the latch 56 engages the striker plate or inner wall 35 of the oven door 26 and pulls the oven door 26 rearwardly causing the seal 45 to be compressed between the oven door 26 and the frame 30.

After cam 54 rotates one hundred-seventy degrees clockwise from the unlatched position, the lobe 160 disengages the contact button 88 of the cam-actuated switch 60 by rotating into a position in which the contact button 88 drops off of the trailing wall 164 of the lobe 160. Upon deactuation of the contact button 88, a timer circuit (not shown) is initiated and further rotation of the motor 52 and the cam 54 attached thereto is locked out until the timer expires indicating the end of the cleaning cycle. The cam-actuated switch 60 is mounted on the top surface 242 of the rear portion 234 of the mounting plate 230 to stop the cam 54 so that the rod-receiving hole 176 is ten degrees before top dead center 192. In this position any effort to try to pull the door 26 open would require the user to overcome the detent force of the motor 52. The detent force of the motor 52 cannot be overcome by pulling on the door 26 because that pulling force is transferred through the rod 62 and exerted through the moment arm defined by the offset of the rod-receiving hole 176 from the radius extending through top dead center 192 of the cam 54. Because the moment arm is so small when the rod-receiving hole 176 is ten degrees from top dead center 192, sufficient torque cannot be generated to overcome the detent force. At the end of the cleaning cycle, the cam 54 rotates approximately one hundred-ninety degrees inducing clockwise rotation of the latch 56 causing the latch 56 to return to the unlatched position.

The manner of operation of the oven lock mechanism 50 can be better understood by understanding the configuration and interaction of the various components of the oven lock mechanism 50. These components are designed and configured to facilitate the above described manner of operation of the oven lock mechanism 50. As previously mentioned, the oven lock mechanism 50 includes a latch 56, a rod 62, a pivot pin 58, a motor 52, a cam 54, a cam-actuated switch 60 and a mounting plate 230.

As shown, for example, in FIGS. 2–6 and 24–26, the latch 56 is configured to facilitate being rotated into an unlatched position, a latched position and a latched and pulled-in position. The latch 56 includes a front end 59 formed to include a hook 57, a rear end 63 formed to include a rod-receiving hole 61 and a central body 64 formed to include a pivot pin-mounting hole 70. Pivot pin-mounting hole 70 is sized to receive the latch shaft wall 118 of the pivot pin 58 therein. The latch 56 is substantially planar having a top surface 65 and a bottom surface 67

The latch 56 is configured to pivot about a pivot axis 69 extending through the pivot pin 58. The latch 56 is mounted for pivotal movement relative to the front portion 232 of the mounting plate 230. Generally, the latch 56 is mounted so that it is positioned above portions of the front portion 232 of the mounting plate 230.

The latch 56 includes a longitudinal axis 71, an outside wall 73, an inside wall 72, and a hook 57. The axis 71 extends from the pivot pin-mounting hole 70 through the rod-receiving hole 61. As shown, for example, in FIG. 25, adjacent to the main body 64, the inside wall 72 and outside wall 73 are both parallel to the axis 71 of the latch 56. The latch 56 is formed to include a hook 57. The inside wall 72 has a curved section 76 coupling a rear straight section 78 to a front straight section 80. The rear straight section 78 and the front straight section 80 are both substantially parallel to the longitudinal axis 71 and the outside wall 73 of the latch 56. The outside wall 73 and the front straight section 80 of the inside wall 72 of the latch 56 extend parallel to the axis 71 in a narrow neck 82 from which the hook 57 extends. The narrow neck 82 is offset outwardly from the axis 71 but is parallel thereto. The hook 57 includes an end wall 75 and an engaging wall 74. The engaging wall 74 extends inwardly from front straight section 80 of inside wall 72. In the illustrated embodiment, engaging wall 74 is substantially perpendicular to the inside wall 72.

Figure 27:
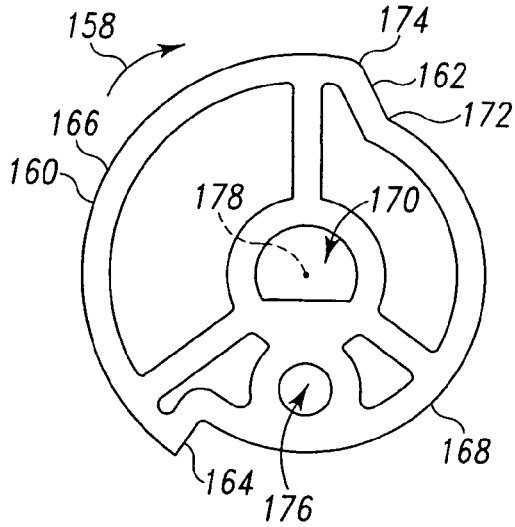
FIG. 27 is a top plan view of the cam of the oven lock mechanism of FIG. 3.

As shown, for example, in FIG. 27, the cam 54 rotates in the direction of the arrow 158 which, from the top of the oven 12, is clockwise. Therefore in describing components of the cam 54, the terms "leading" and "trailing" will be used to describe various components with the understanding that "leading" refers to a component that is clockwise with respect to the "trailing" component.

Figure 29:
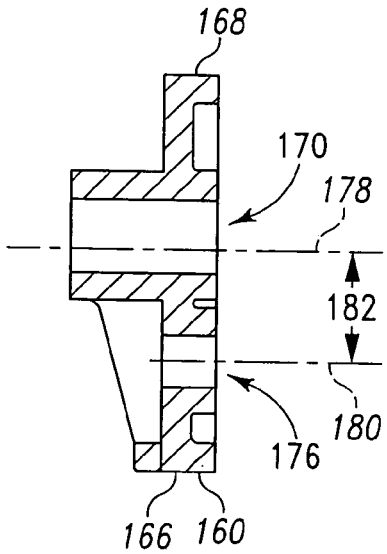
FIG. 29 is a sectional view taken along line 29—29 of the cam of FIG. 28.
Figure 28:
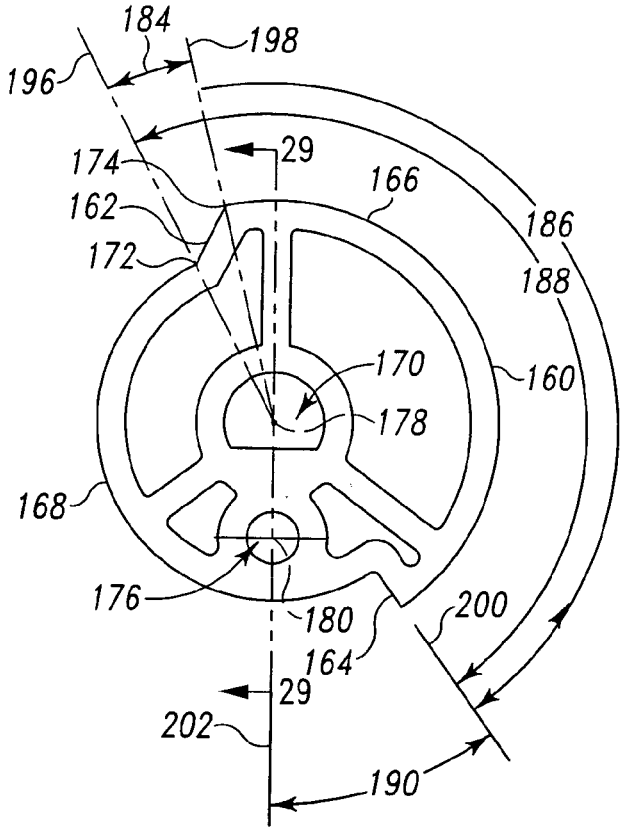
FIG. 28 is a bottom plan view of the cam of FIG. 27.

As shown, for example, in FIGS. 27–29, the cam 54 includes a lobe 160 formed around an axis 178 extending through the D-shaped shaft-mounting bore 170 extending through a central body 168. The D-shaped motor driven shaft 98 is received D-shaped mounting bore 170 to couple the cam 54 to the shaft 98 of the motor 52. The lobe 160 includes a leading side wall 162, a trailing side wall 164 and a camming surface 166. Camming surface 166 extends between the leading and the trailing side walls 162, 164.

The leading side wall 162 extends at an angle outwardly from central body 168. The leading side wall 162 illustratively is formed so that an angle 184 of eighteen degrees is subtended by the radius 196 extending through its junction 172 with the central body 168 and the radius 198 extending through its junction 174 with the camming surface 166. The trailing side wall 164 extends radially outwardly from the central body 168. The radius 196 extending through the junction 172 of the leading side wall 162 and the central body 168 and radius 200 extending through the trailing side wall 164 of the lobe 160 form an angle 188 of one hundred sixty-seven and two-tenths degrees with respect to each other. The radius 198 extending through the junction 174 of the leading side wall 162 and the camming surface 166 and radius 200 extending through the trailing side wall 164 of the lobe 160 form an angle 186 of one hundred eighty-five and two-tenths degrees with respect to each other. Additionally, the radius 202 extending through the center 178 of shaft-receiving bore 170 and the center 180 of rod-receiving hole 176 and radius 200 extending through the trailing side wall 164 of the lobe 160 form an angle 190 of thirty four and seven tenths degrees with respect to each other.

The central body 168 of cam 54 is formed to include a rod-receiving hole 176. Rod receiving-hole 176 is sized to receive vertical leg 152 of cam end 132 of rod 62 therein. The center or axis 180 of rod-receiving hole 176 is radially offset from the center or axis 178 of D-shaped shaft receiving aperture 170 by a distance 182. Illustratively distance is 0.29 in. so that rotation of cam by 180 degrees induces reciprocal movement of rod 62 by approximately 0.58 in.

Those skilled in the art will recognize that the cam 54 serves two functions in the disclosed oven lock mechanisms 50, 350, 650. These functions will be described with regard to oven lock mechanism 50 only for simplicity. First the camming surface 166 interacts with the contact 88 of the switch 60 so that the switch 60 can appropriately signal when the latch 56 has reached the latched and pulled-in position and when the latch has reached the unlatched position. Second, the cam 54 acts as a rotor arm coupled to the cam end 132 of the rod 62 so that rod 62 can convert rotational movement of the cam into translational movement of the rod 62. This translational movement of the rod 62, causes both translation and rotational movement of the latch 56. Thus, it is within the scope of the disclosure for a separate switch actuating cam and rotor arm to be provided. Also, while all of the benefits of the disclosed oven lock mechanisms would not be recognized, it is within the scope of the disclosure for a separate rotor arm to be provided without a switch actuator.

As shown, for example, in FIGS. 19–23, the rod 62 includes a latch end 130, a cam end 132, a straight section 134, a front offset arm 136, a front horizontal arm 140, a front vertical leg 142, a lateral horizontal leg 144, a rear offset arm 146 a rear horizontal arm 150, a rear vertical leg 152 and a retainer leg 154. The straight section 134, front offset arm 136 and rear offset arm 146 span the distance between the front portion 232 of the mounting plate 230 and rear portion 234 of the mounting plate 230. The length of the straight section 134 is selected based upon the depth of the oven 12 and the lateral offset of the front portion 232 and rear portion 234 of the mounting plate 230. The straight section 134 of the rod 62 is positioned to ride on or slightly above the top surface 242 of the middle portion 236 of the mounting plate 230 and to ride in the channel 262 under the cantilevered arm 264 of the directional positioner 260 and against the upright urging wall 258.

Rod 62 is coupled at its latch end 130 to the latch 56. The front offset arm 136 extends upwardly and forwardly from the front end of the straight section 134 at an angle 138 of approximately 30 degrees. The front horizontal arm 140 extends forwardly from the front upper end of the front offset arm 136. The vertical leg 142 extends downwardly from the front end of horizontal arm 140. The vertical leg 142 is sized to be received in, and extend through, the rod-receiving hole 61 formed in latch 56. The lateral horizontal leg 144 extends horizontally laterally from the bottom end of the vertical leg 142. Lateral horizontal leg 144 prevents rod 62 from inadvertently disconnecting from latch 56 during rotation thereof.

The rod 62 couples the latch 56 and the cam 54 together so that movement of one component is transferred to the other. Thus, at its cam end 132, rod 62 is coupled to cam 54. The vertical leg 152 of rod 62 is sized to be received in, and extend through, the rod-receiving hole 176 formed in cam 54. Diametrically opposed ears 156 extend radially from the vertical leg 152 to act as a stop that engages the top surface of cam 54 adjacent the rod-receiving hole 176 to prevent the upper portion of vertical leg from extending into the rod-receiving hole 176. Illustratively, vertical leg 152 is pinched to form ears 156. Retainer leg 154 extends at an angle from the bottom end of vertical leg 154 to retain rod 62 within rod-receiving hole 176 in cam 54. Together ears 156 and retainer leg 154 help to maintain the vertical orientation of vertical leg 152 when it is received in rod-receiving hole 176 so that the axis of vertical leg remains substatially parallel to, if not co-linear with, the axis 180 about which rod-receiving hole 176 is concentrically formed. The top end of vertical leg 152 is coupled to rear horizontal arm 150 which is coupled through rear offset leg 146 to the rear end of straight section 134. Rear offset leg 146 forms an angle 148 of approximately thirty degrees with the straight section 134.

In the illustrated embodiment, rod 62 is formed from a single rod or wire bent and shaped to form the configuration shown in FIGS. 19–22. Thus rod 62 is monolithic, or formed from a single unitary piece of metal. Illustratively, rod 62 is formed from one-eighth inch three quarter tempered C1008, class 3 galvanized steel wire. Therefore, rod 62 is formed from what is commonly referred to as spring steel wire. It is within the scope of the disclosure for rod 62 to be formed from other spring steel wire such as one half tempered galvanized steel.

As a result of being formed from bending, shaping, stamping, pinching and otherwise deforming wire, the illustrated rod 62 is very cost efficient to manufacture. While the low cost benefits of the illustrated rod 62 might not be recognized, it is within the scope of the disclosure for rods or linkages formed from other materials and manufactured in other ways to be used in the disclosed oven lock mechanisms 50, 350, 650. It is also within the scope of the disclosure for rods or linkages to be formed from multiple components coupled together to form a rod or linkage.

As a result of the tempering, deformation of rod 62 by being bowed between cam 54 and latch 56 while extending around riding wall 59 of urging wall 58 does not result in permanent deformation of rod 62 but rather creates a restorative force in rod 62 urging rod 62 to return to its straight state. This restorative force causes a lateral force to be present at the latch end 130 of rod 62 which is transferred through the walls of rod-receiving hole 61 to urge latch 56 to rotate counterclockwise during portions of the rearward and forward translation of rod 62 induced by rotation of cam 54.

The illustrated mounting plate 230 is stamped and formed from a single sheet of metal such as nickel electroplated bright nickel. The mounting plate 230 includes three regions, a front portion 232, a rear portion 234 and a middle portion 236. The front and rear portions 232, 234 both include essentially two regions, a substantially planar component mounting portion and an offset oven mounting portion.

The oven mounting portion of the front portion 232 of the mounting plate 230 includes a lip 240. The lip 240 is coupled to and extends upwardly from the front edge of the component mounting portion 238. The upwardly extending lip 240 is formed to include two mounting holes 243 and a latch slot 250 extending between the front surface 246 and the rear surface 248. Fasteners (not shown) extend through the two mounting holes 243 to mount the front portion 232 of the mounting plate 230 to the oven frame 30 so that the front surface 246 engages the front wall 19 of the oven frame 30. The latch 56 extends through slot 250 and rotates clockwise and counterclockwise therein between the upwardly extending end walls 247, 249 of the slot 250. As shown, for example, in FIG. 3, end wall 249 acts as a stop against which outside wall 73 of latch 56 rests when in the unlatched position. As shown, for example, in FIGS. 4 and 5, end wall 247 acts as a stop against which inside wall 80 of neck 82 of latch 56 rests when in one of the latched positions.

The component mounting portion 238 is substantially planar. Component mounting portion 238 extends rearward from the upwardly extending lip 240 to a downwardly extending lip 241 formed at an angle with respect to the lip 240. The middle portion 236 extends rearwardly from the bottom edge of downwardly extending lip 241.

The front portion 232 of mounting plate 230 is formed to include a pivot pin guide channel 252 defined by a semicircular front wall 255 coupling two side walls 251, 253 formed symmetrically about a longitudinal axis 254. As shown, for example, in FIG. 12, longitudinal axis 254 is offset slightly inwardly from the inner end wall 247 of latch slot 250. This offset is equal to the amount the inner wall 80 of neck 82 of latch 56 is offset outwardly from the longitudinal axis 71 of the latch 56 which extends through the pivot pin-mounting hole 70 and rod-receiving hole 61 of the latch 56. Thus, when inside wall 80 of neck 82 of latch 56 engages the inner end wall 247 of latch slot 250, the axis 71 of the latch 56 coupled to the pivot pin 58 received in the guide channel 252 is perpendicular to the front lip 240 of mounting plate 230.

Figure 12:
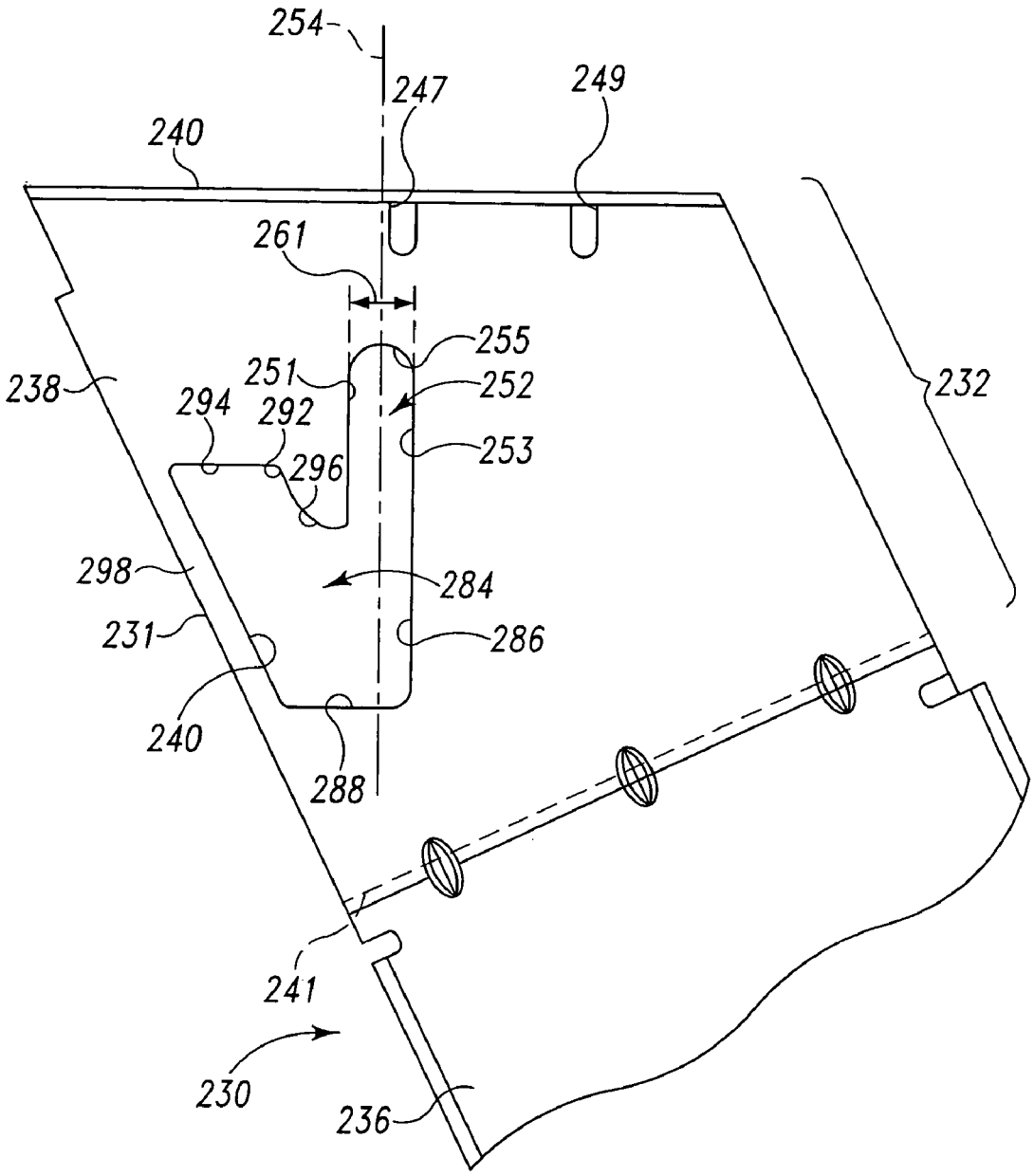
FIG. 12 is an enlarged view of the front portion of the mounting plate of FIG. 11 showing the channel formed for translation of the latch.
Figure 13:
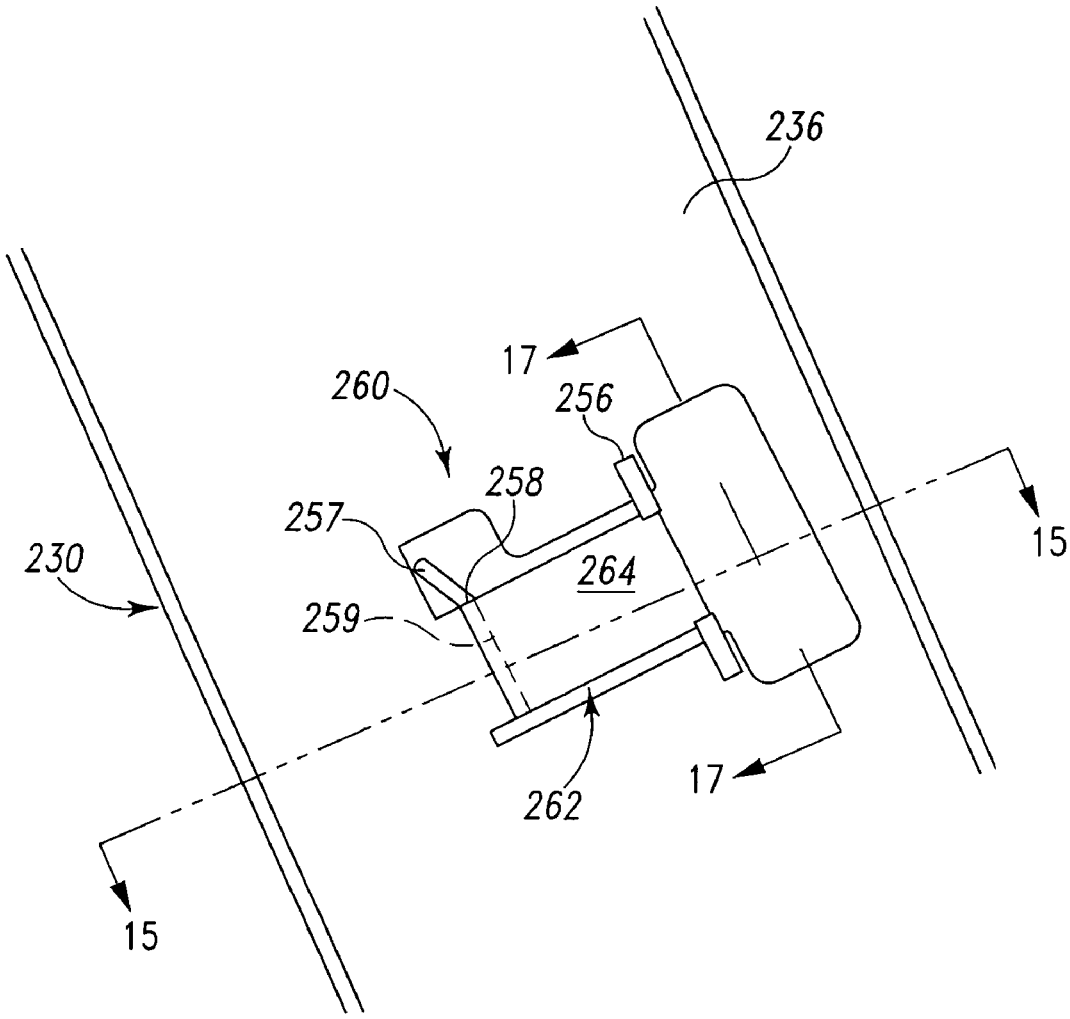
FIG. 13 is an enlarged view of the middle portion of the mounting plate of FIG. 11 showing the rod guide formed therein.
Figure 14:
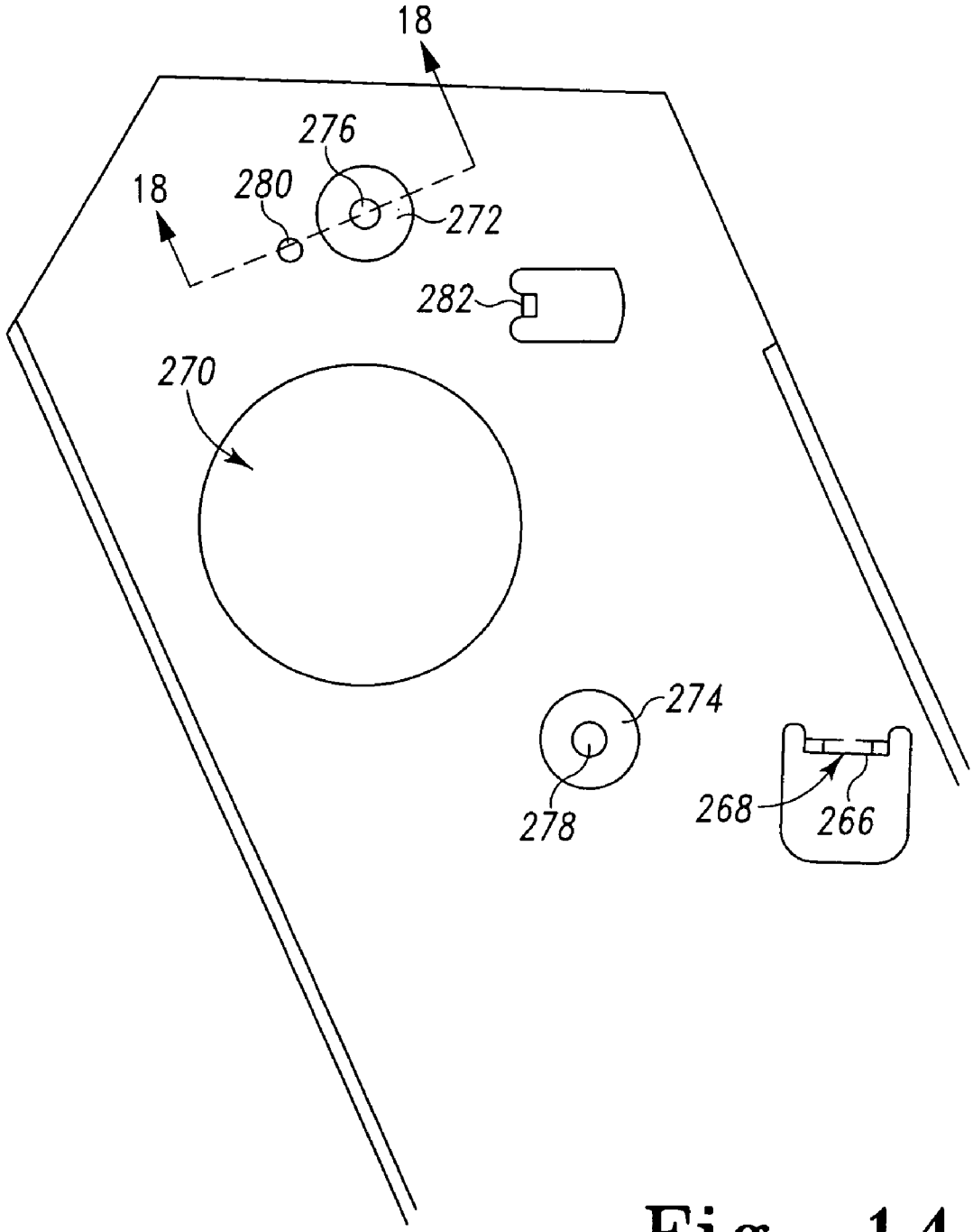
FIG. 14 is an enlarged view of the rear portion of the mounting plate of FIG. 11.
Figure 16:
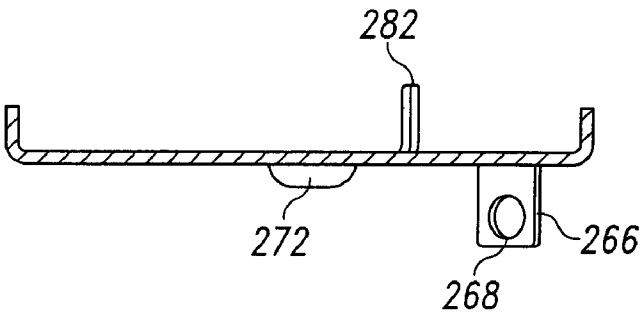
FIG. 16 is a sectional view taken along line 16—16 of FIG. 11.
Figure 18:
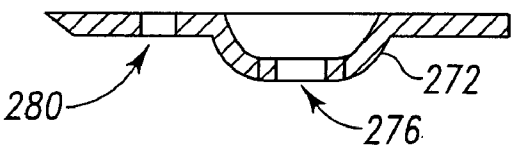
FIG. 18 is a sectional view taken along line 18—18 of FIG. 14.
Figure 15:
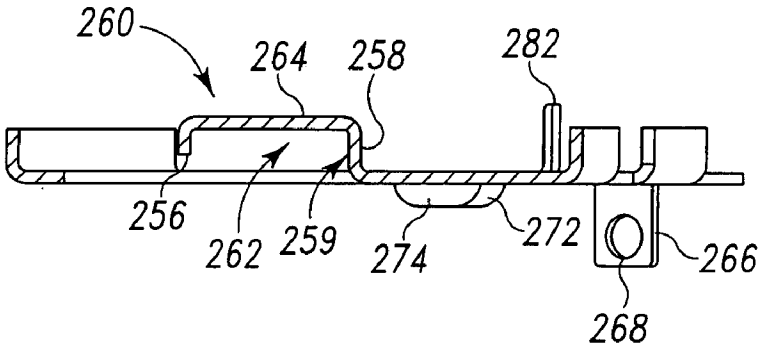
FIG. 15 is a sectional view taken along line 15—15 of FIG. 13.
Figure 17:
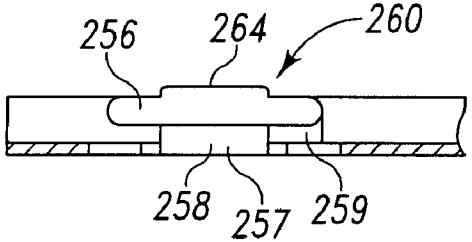
FIG. 17 is a sectional view taken along line 17—17 of FIG. 13.
Figure 19:
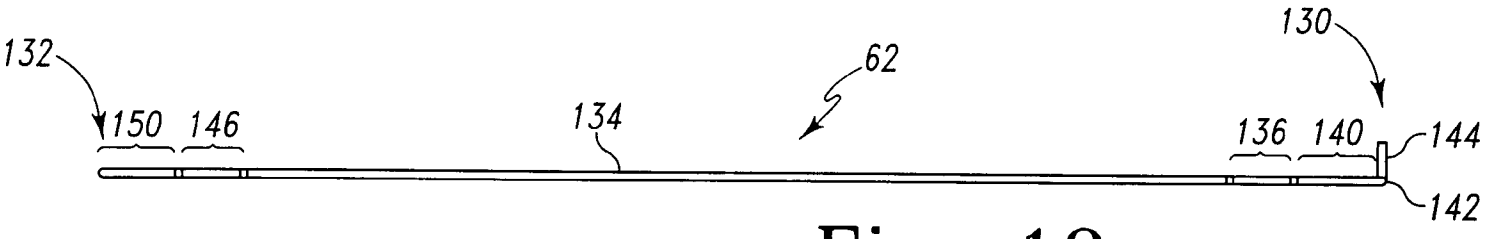
FIG. 19 is a top view of the rod of the oven lock mechanism of FIG. 3.
Figure 20:
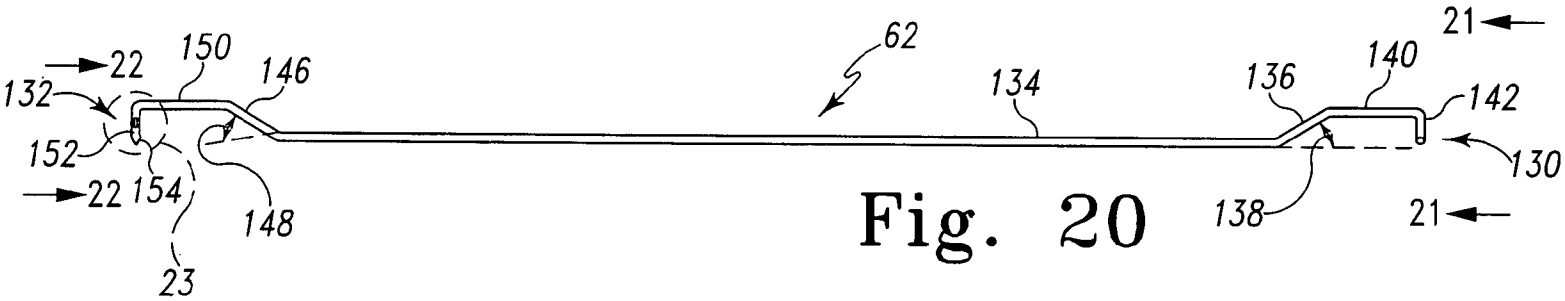
FIG. 20 is a side elevation view of the rod of FIG. 19.
Figure 23:
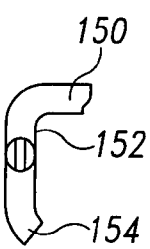
FIG. 23 is detailed view of the rear end of the rod contained in phantom circle 23 in FIG. 20.
Figure 22:
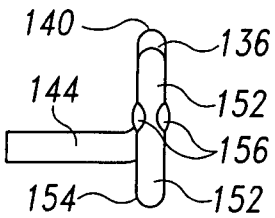
FIG. 22 is a rear end elevation view of the rod taken along line 22—22 of FIG. 20.
Figure 21:
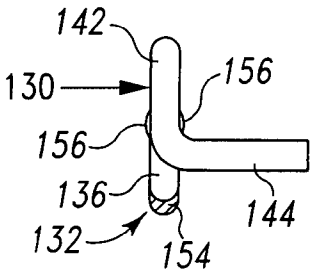
FIG. 21 is a front end elevation view of the rod taken along line 21—21 of FIG. 20.
Figure 26:
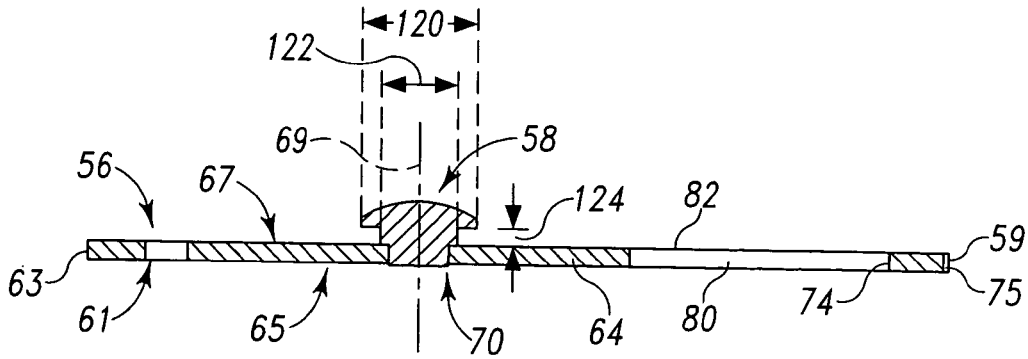
FIG. 26 is a sectional view of the latch and pivot pin taken along line 26—26 of FIG. 25.
Figure 25:
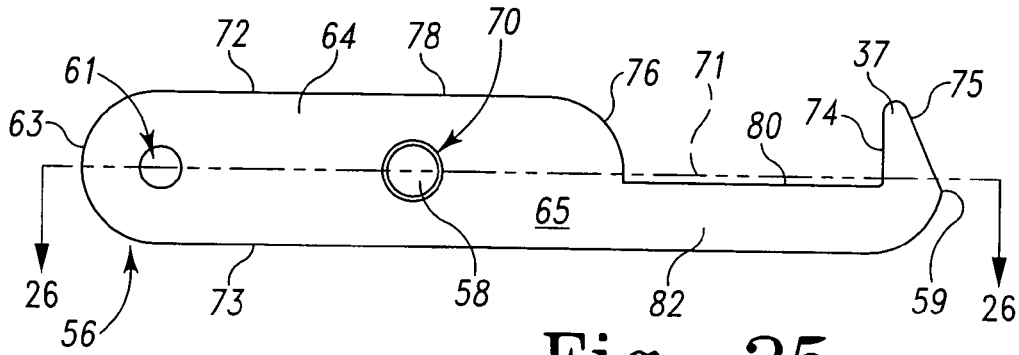
FIG. 25 is a plan view of the latch and pivot pin of FIG. 24.
Figure 24:
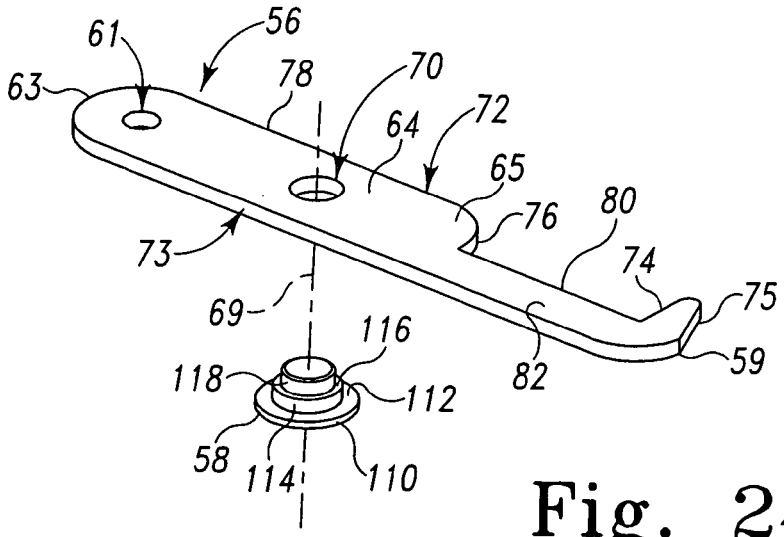
FIG. 24 is an exploded view of the latch and pivot pin of the oven lock mechanism of FIG. 3.

The side walls 251 and 253 and axis 254 extending rearwardly perpendicular to the lip 240, as shown, for example, in FIG. 12. The guide channel 252 has a width 261 slightly greater than the diameter 112 of the slide shaft wall 114 of the pivot pin 58. Width 261 is less than the diameter 120 of the head 110 of pivot pin 58 so that portions of the peripheral wall 112 of pivot pin 58 engage the bottom surface 244 of the component mounting portion 238 adjacent the guide channel 252 when the pivot pin 58 is received in the guide channel 252. Illustratively, the rear end of guide channel 252 opens into a rod opening 284. It is within the scope of the disclosure for guide channel 252 and rod opening 284 to not be in communication as pivot pin 58 does not translate rearwardly in guide channel 252 far enough to enter rod opening 284 and latch end 130 of rod 62 does not enter into guide channel 252.

In the illustrated embodiment, rod opening 284 includes an outside wall 286, a rear wall 288, an inside wall 290, and a front wall 292. Front wall 292 includes a straight portion 294 extending outwardly from the front end of the inside wall 290 parallel to the front lip 240 and a curved portion 296 extending rearwardly and outwardly from the straight wall 294 to the rear end of the inside wall 251 of the guide channel 252. The curved portion 296 comes into engagement with the vertical leg 142 of latch end of rod 62 and guides the same inwardly to induce latch to rotate clockwise toward the unlatched position during forward movement of the rod 62.

Outside wall 286 of rod opening 284 is illustratively an extension of outside wall 253 of guide channel 252 and thus extends rearwardly perpendicular to front lip 240. Thus, a rod 62 received in the rod-receiving hole 61 formed on latch 56 never engages outside wall 286 of the rod opening 284 as engagement of the inside wall 80 of the neck 82 of the latch 56 with the inner wall of the slot 250 prevents latch from rotating counter-clockwise to the point that such contact could be made. Rear wall 288 of rod opening 284 is perpendicular to outside wall 286 and extends inwardly toward inner wall 231 of front mounting portion 232 of mounting plate 230. Rear wall 288 is formed far enough rearwardly that latch end 130 of rod 62 does not engage rear wall 288. For these reasons, rod opening 284 is not referred to as a guide opening.

Inner wall 290 extends forwardly and inwardly from the inner end of rear wall 288. Inner wall 290 of rod opening 284 is parallel to inside wall 286 of front portion 323 of mounting plate 230. The strip 298 of mounting plate component 238 disposed between inner wall 290 of rod opening 284 and inside wall 231 of front portion 232 of mounting plate 230 cooperates with lateral horizontal leg 144 to inhibit twisting of rod 62. The lateral horizontal leg 144 of latch end 130 of rod 62 extends under strip 298 as shown, for example, in FIGS. 3–6 and 8.

The front portion 232 of the mounting plate 230 is configured to facilitate mounting the latch 56 so that it can assume a non-latching, latching and latching and pulled-in positions. The latch 56 is mounted to pivot about a translatable pivot axis 69 relative to the front portion 232 of the mounting plate 230. During assembly, the shafts 114, 118 of the pivot pin 58 are inserted from the bottom side of mounting plate 230 through the guide channel 252 until the peripheral wall 112 of the head 110 engages the bottom surface 244 of the front portion 232 of the mounting plate 230. The latch shaft wall 118 of the pivot pin 58 is received in the pivot pin mounting hole 70 of the latch 56 and staked therein. The bottom surface of the latch 56 rests on the peripheral wall 116 extending between the latch shaft wall 118 and the slide shaft wall 114 of the pivot pin 58. Slide shaft wall 114 has a length 124 slightly greater than the thickness of the mounting plate 230 so that pivot pin 58 can slide forwardly and rearwardly within the guide channel 252 between the semi-circular front wall 255 and a rear position limited by the rearward translation of the rod 62. Additionally, since the diameter 122 of slide shaft wall 114 is slightly less than the width 261 of guide channel 252, pivot pin 58 may rotate and pivot freely within guide channel 252.

Rotation of pivot pin 58 is limited only by engagement of the latch coupled thereto with the upright end walls 247, 249 of the latch slot 250. Rotation of the latch 56 in a counter-clockwise direction (as seen from above) is limited by the inner wall 80 of the neck 82 of the latch arm 56 coming into engagement with the inner wall 247 of the slot 250. Similarly, clockwise rotation of the latch 56 is limited by the outer wall 73 of the latch 56 coming in contact with the outer wall 249 of the slot 250.

The rear portion 234 of the mounting plate 230 is configured to facilitate mounting the motor 52 and the cam 54 in a fixed position relative to the rear portion 234 of the mounting plate 230. The motor 52 and the cam 54 are mounted in a position so that the lobe 160 of the cam 54 interacts with the contact button 88 of the cam-actuated switch 60. Thus, the rear portion 234 of the mounting plate 230 includes a motor shaft-receiving hole 270 sized to permit the motor driven shaft 98 and the central body 168 of the cam 54 to extend therethrough and rotate therein without engaging the walls of the hole 270.

Two frusto-conical motor mount bosses 272, 274 extend downwardly from the bottom surface 244 of the rear portion 234 of the mounting plate 230. Motor-mounting holes 276, 278 extend through the flat bottom surfaces of each motor mount boss 272, 274, respectively, of the rear portion 234 of the mounting plate 230. Fasteners 106, 108 are received in motor-mounting holes 276, 278, respectively, in rear portion 234 of the mounting plate 230 and motor-mounting holes 94, 96, respectively, in the motor 52 to mount the motor 52 to the rear portion 234 of the mounting plate 230. Motor-mounting holes 276, 278 are disposed on the rear portion 234 of the mounting plate 230 to facilitate mounting motor 52 to the rear portion 234 of the mounting plate 230. When the fastener 106 extends through the mounting holes 94, 276 and the fastener 108 extends through the mounting holes 96, 278, the motor driven shaft 98 is disposed in the center of the shaft-receiving hole 270. The cam 54 is mounted on the motor driven shaft 98 to interact with the contact 88 of the cam-actuated switch 60.

The rear portion 234 of the mounting plate 230 is configured to facilitate mounting the cam-actuated switch 60 on the mounting plate 230 at a location in which the cam 54 engages the contact button 88 of the switch 60. The mounting plate 230 is formed to include a switch mounting hole 280 and a switch mounting post 282 extending upwardly from the top surface 242 of the rear portion 234. The mounting post 282 extends through a mounting hole 89 in the switch 60. A fastener 284 (FIGS. 3–5) extends through the switch mounting hole 280 and mounting hole (obscured by fasteners 284) on the cam-actuated switch 60 to secure the switch 60 to the mounting plate 230. The mounting hole 280 and mounting post 282 are positioned and configured to place the contact button 88 of the cam-actuated switch 60 where it can be actuated by the lobe 160 during rotation of the cam 54.

As show, for example, in FIGS. 3–6, 13, 15–17, the middle portion 236 of mounting plate 230 is formed to facilitate urging the latch 56 in the proper direction during rotation of the cam 54 and translation of the rod 62. Middle portion 236 is formed to include directional positioner 260. Directional positioner 260 includes an upright urging wall 258, a cantilevered laterally extending arm 264, and a downwardly extending retention lip 256 that combine to form a channel 262 within which the straight section 134 of the rod 62 rides. In the illustrated embodiment, upright urging wall 258 extends perpendicularly from the top surface 242 of the middle position 236 of the mounting plate 230 and is formed to include a curved front lip 257 and straight riding wall 259. Curved front lip 257 provides a rounded surface against which rod 62 initially engages when riding rearwardly against straight riding wall 259 of the upright urging wall 258. Cantilevered arm 264 extends laterally from the top edge of urging wall 258. Retention lip extends downwardly from the distal end of cantilevered arm 264.

Directional positioner 260 is positioned between the cam 54 and the latch 56 so that the rod 62 coupling the two rides within channel 262 during rotation of the cam 54 and the corresponding reciprocal translation of the rod 62. While described as being positioned so that the rod 62 is constantly in engagement with riding wall 59 of upright urging wall 58, it is within the scope of the disclosure for the rod 62 to not engage the riding wall 59 during portions of the travel from the unlatched to the latched positions.

Since the rod 62 is flexed in operation of the oven lock mechanism 50, the rod 62 may begin to bend vertically instead of horizontally as desired. Cantilevered arm 264 engages the rod 62 to limit the undesirable vertical flexing of rod 62. Thus, the rod 62 is induced to flex in the horizontal plane so that the rod urges the latch into the latched position during rearward translation of the rod 62 and during a substantial portion of forward translation of the rod 62.

Those skilled in the art will recognize that disclosed mounting plate 230 may be easily and inexpensively formed by appropriately pressing, cutting, bending, drilling and forming a sheet of metal. All of the above described structures and components of the mounting plate 230 are formed through such fabrication techniques. Other components of the mounting plate 230, such as the upwardly extending side walls that create structural rigidity in middle portion 236 of the mounting plate 230 are also formed through such fabrication techniques. While the cost savings inherent in fabricating mounting plate 230 would not be recognized, it is within the scope of the disclosure for other mounting plates to be used in conjunction with the oven lock mechanisms 50, 350, 650 described herein.

The oven lock mechanisms 50, 350, 650 disclosed herein utilize a cam 54, motor 52 and rod 62 to position the latch 56, 656 in a latched position and a latched and pulled-in position when a self-cleaning cycle is initiated. When the latch 56, 656 is placed in such latched and pulled-in position, any attempt to open the oven door 26 is unsuccessful since the cam 54 and rod 62 are positioned to prevent the latch 56, 656 from pivoting back to its unlatched position. At the end of the self-cleaning cycle, a signal is sent to the motor 52 and the cam 54 is rotated to an unlatched position. The oven door 26 can then be opened.

While the oven lock mechanisms 50, 350, 650 disclosed herein use the motor 52 and a cam 54 to move the latch 56, 656 once it is in the latched position to a latched and pulled-in position, it is within the scope of the disclosure for the motor 52 to actuate movement of the cam 54 into the latched position without inducing additional movement of the latch 56, 656.

Figure 30:
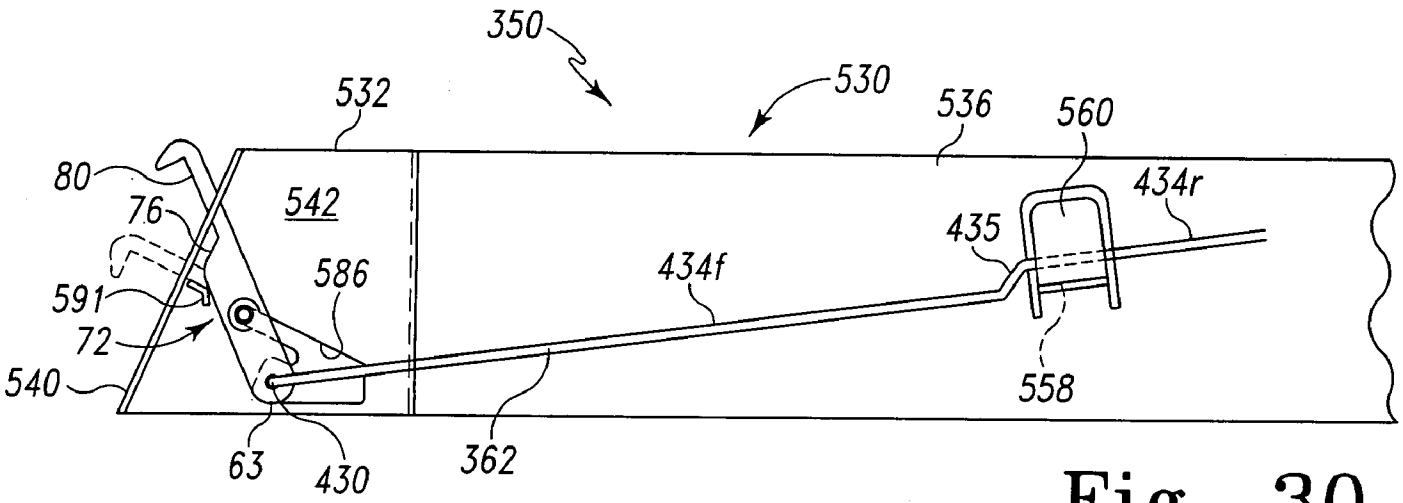
FIG. 30 is a top plan view of a front and middle portion of a second embodiment of an oven latch mechanism shown in an unlatched position.
Figure 31:
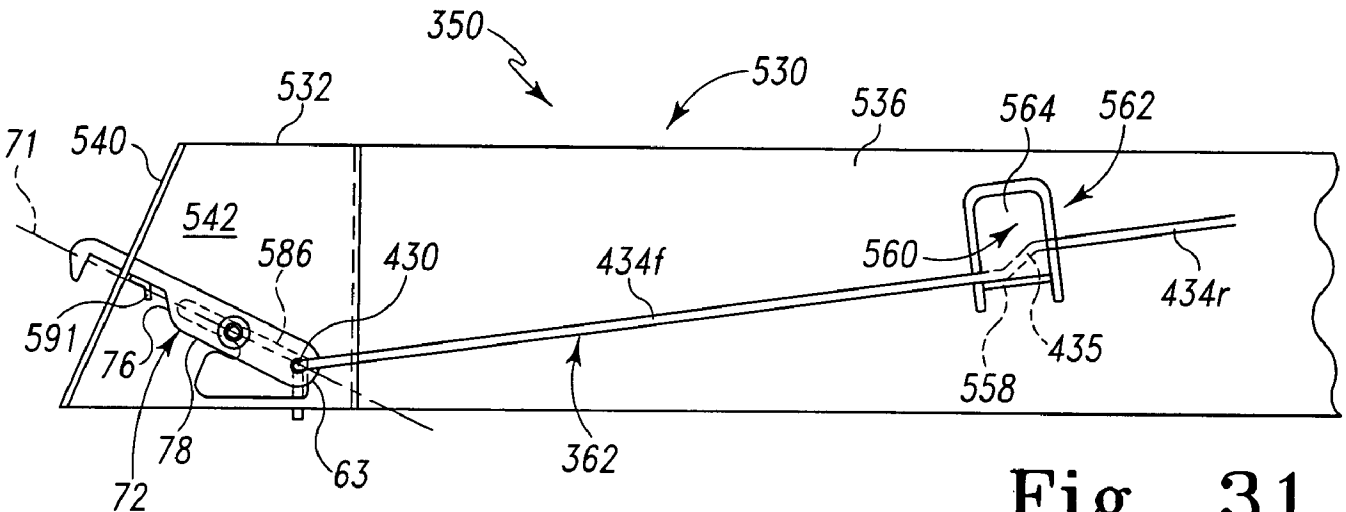
FIG. 31 is a top plan view of the oven lock mechanism of FIG. 30 shown in a latched and pulled in position.
Figure 33:
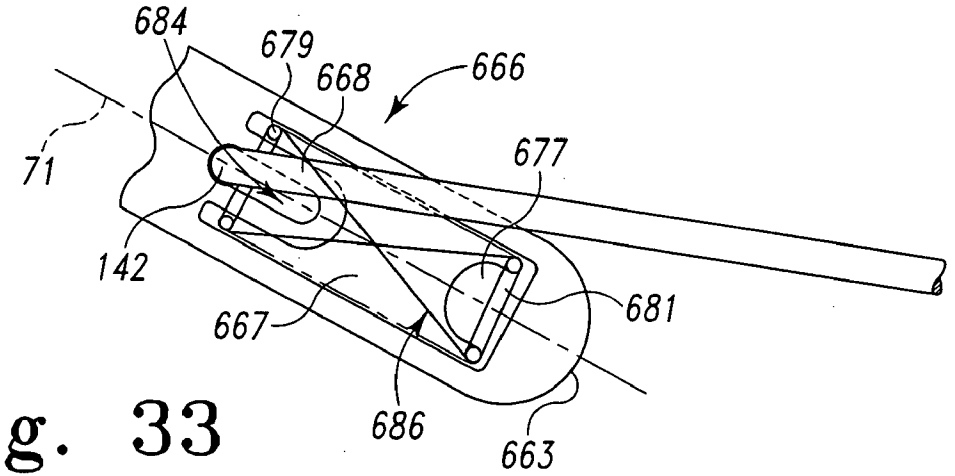
FIG. 33 is an enlarged view of the motor torques stabilizer of the oven lock mechanism of FIG. 32 with the compression spring shown diagrammatically to expose other features of the stabilizer.
Figure 32:
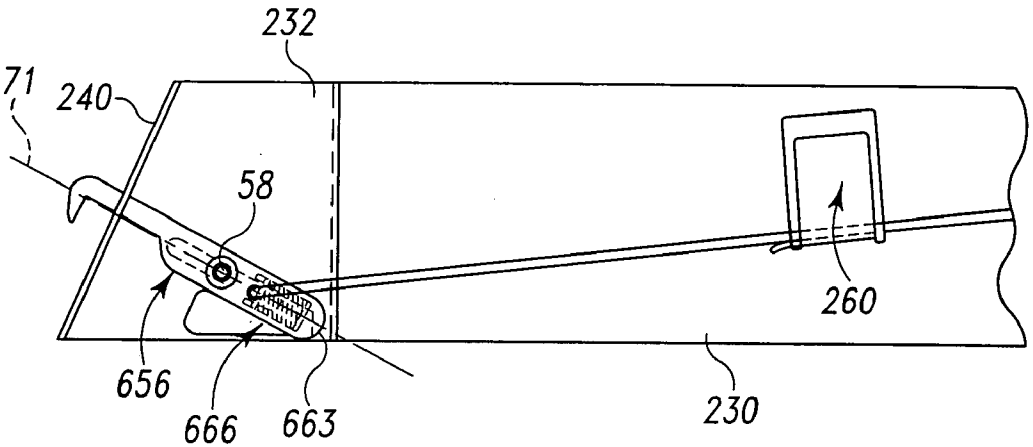
FIG. 32 is a top plan view of a front and middle portion of a third embodiment of an oven lock mechanism with a motor torque stabilizer.
Figure 35:
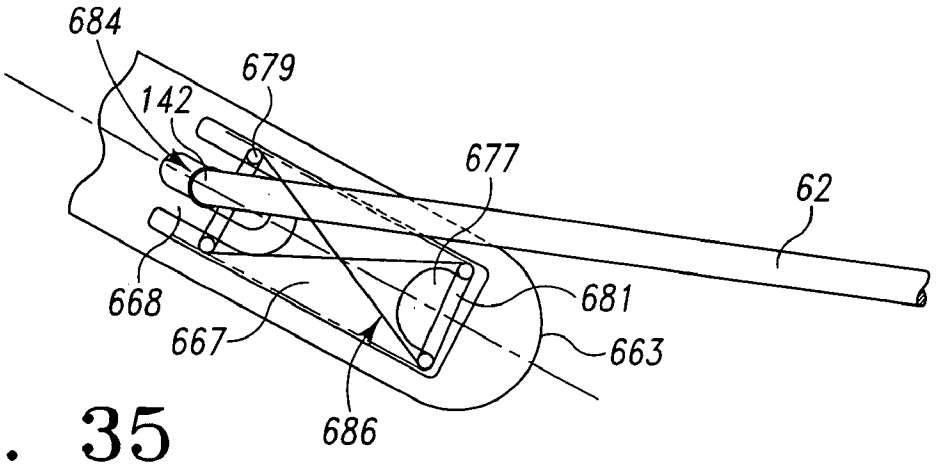
FIG. 35 is an enlarged view of the motor torques stabilizer with the compressed compensation spring of the oven lock mechanism of FIG. 34 with the compression spring shown diagrammatically to expose other features of the stabilizer.
Figure 34:
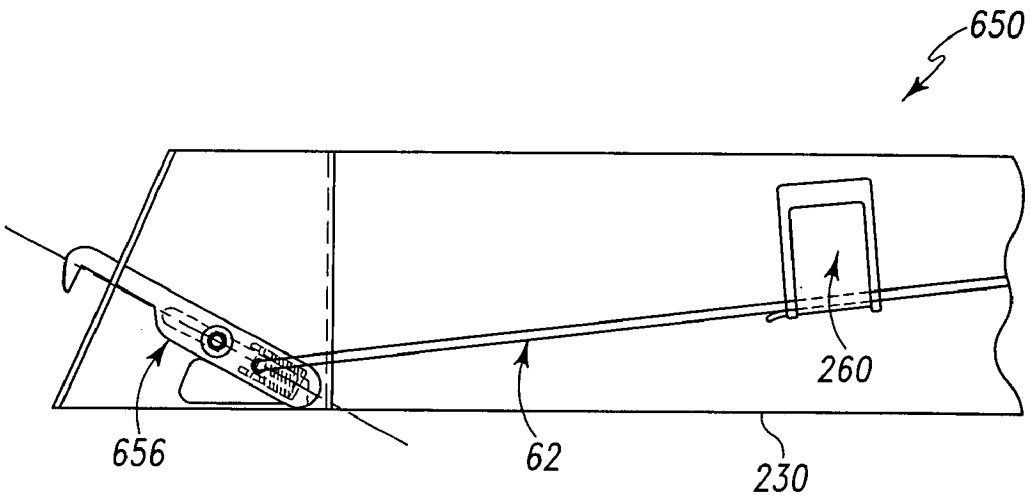
FIG. 34 is a top plan view of a front and middle portion of a third embodiment of an oven lock mechanism with a motor torque stabilizer with the compensation spring compressed to reduce excess torque on the motor resulting from tolerance build-up.

As shown for example in FIGS. 30, 31, the second embodiment of the motorized oven lock mechanism 350 includes a latch 56, a rod 362, a latch pivot pin 58, and a mounting plate 530. Although only the front portion 532 and middle portion 536 of the mounting plate 530 are shown, it is to be understood that a motor 52, a cam 54 and a cam-actuated switch 60 are mounted to the rear portion of the mounting plate 530 and the rod 362 is coupled to the cam 54 in the manner described above. Mounting plate or bracket 530 is formed to include a directional positioning guide flange 560 through which a lazy-S bend 435 in the rod 362 passes to induce the rod 362 to urge the latch 56 toward the unlatched position as the motor 52 rotates the cam 54 toward its unlatched position.

Rod 362 differs from rod 62 described above by including the lazy-S bend 435 in the straight section 434 which includes a front straight section **434*f* and a rear straight wall section 434*r*. The lazy-S bend 435 is positioned to interact with the front edge of the upright urging wall 558 of the directional positioning guide flange 560 during rearward movement of the rod 362 to induce the latch 52 to pull rearwardly with its axis 71 substantially perpendicular to the front lip 540 of mounting plate 530. When the cam 54 and the latch 56 are in the unlatched position, as shown, for example, in FIG. 30, the rod 362 does not engage the directional positioner 560. Thus, in the unlatched state, the rod 362 is free from stress and remains unstressed during the normal use of the range 10. Rod 362** only becomes stressed during a self cleaning-cycle.

During clockwise rotation of cam 54 from the unlatched position to the latched position during the start of a self-cleaning cycle, the lazy-S bend 435 in the rod 362 contacts the directional positioner 560 moving the latch from the unlatched position to the latched position. So long as the front straight section **434*f* of the rod 362 is in contact with the directional positioner 560, the urging wall 558 of the directional positioner 560 applies a lateral force to the front straight section 434*f* of the rod 362. As a result of this lateral force, rod 362 is slightly bowed so that the latch end 430 of the rod 362 applies a lateral force toward the outside wall 586 against the wall of the rod-receiving hole 61 to urge the latch 56 to rotate counter-clockwise into, and remain in, the latched position. This ensures that the latch 56** will be pulled directly back for a specified distance prior to stopping in the latched and pulled-in state. For ease of repair, while in the latched and pulled-in state, a service repairman can insert a tool and push the latch toward the unlatched state to open the oven door.

At the completion of the self-cleaning cycle, a signal is sent to the motor 52 initiating the unlock movement of the oven door lock mechanism 350. During rotation of the cam 54 past top dead center toward the unlatched position, so long as urging wall 558 of directional positioner 560 engages the front straight section **434*f* of rod 362, the latch 56 moves straight forward without rotating toward the unlatched position. Once the lazy-S bend 435 has moved forward past the directional positioner 560, rod 362 permits the rear end 63 of latch 56 to rotate counter-clockwise permitting the latch 56** to rotate into the unlatched position.

Mounting plate 530 differs from mounting plate 230 in one other significant way. Mounting plate 530 is formed to include a deflector 591 (not found in plate 230) extending upwardly from the top surface 542 of the front portion 532 adjacent the inside upwardly extending wall of the latch-receiving opening. Should the latch 56, for whatever reason, fail to pivot into the unlatched position prior to reaching the full forward position, the rounded surface 76 of the inside wall 72 of the latch 56 comes into engagement with and rides against the deflector 591 to rotate the latch 56 into the unlatched position.

Directional positioner 560 differs from directional positioner 260 because positioner 560 does not include the curved urging arm 28 found in positioner 260 to prevent rod 62 from riding against a sharp corner of the positioner 260. Those skilled in the art will recognize that guide flange 560 can be utilized with any of the disclosed oven lock mechanisms disclosed herein and that guide flange 260 could be used with the second embodiment of oven lock mechanism 350.

As shown, for example, in FIGS. 32–35, a third embodiment of oven lock mechanism 650 is substantially similar to the oven lock mechanism 50 but is formed to include a latch 656 that compensates for tolerance build up between the parts to stabilize the torque of the motor 52. The torque compensator 666 of the latch 656 includes a spring slot 667, a front finger 668 formed to include a rod slot 684, a rear finger 677, a compression spring 686 (shown diagrammatically in FIGS. 33 and 35 as an X to permit other components to be seen more clearly), a front spring seat 679 and a rear spring seat 681. The interaction of the rod 62, directional positioner 260 and motor 52 operating in a clockwise rotation is designed to provide force at the latch 656 to insure that the latch will move in a direction perpendicular to the front wall 19 of the frame 30 of the oven 12 for a specified distance to insure a smooth unlock movement.

When a self-cleaning cycle is selected, the motor 52 turns the cam 54 clockwise. The rod 62 contacts the directional positioner 260 to slightly flex the rod 62 so that the latch end 130 exerts a lateral force on the side wall of the rod slot 684 to induce rotation of the latch 656 from the unlatched position to the latched position. The interaction between the rod 62 and the directional positioner 260 insures the latch 656 will pull directly back for a specified distance prior to stopping in the latched and pulled in position. During the pull-in mode, the motor torque stabilizer 666 is designed to eliminate the possibility of the motor 52 stalling due to a build-up of tolerances in the range 10 preventing the door 26 from positioning itself in a normal set. If as a result of tolerance build up, the oven lock mechanism 650 pulls the door 26 into engagement with the frame 30 of the oven 12 with the pull-in force desired by the customer before the cam reaches the latched and pulled-in position, the compression spring 686 compresses allowing rod 62 to slide rearwardly in rod slot 684 while the remainder of the latch 656 remains stationary. The torque stabilizer 666 could be applied to several locations in the assembly, but in the illustrated embodiment is incorporated into the latch 656.

The pull-in force at the door 26 is variable depending upon the oven manufacturer's wants and needs. For instance, an oven manufacturer could desire a four-pound pull on the door 26. If a four pound pull is desired, a four-pound, or there about, compression spring 686 is utilized in motor torque compensator 666. During a lock sequence, with latch 656 pulling on the door 26, when the torque stabilizer spring 686 encounters a four-pound resistance, it will compress compensating for an out-of-tolerance assembly. As a result of this compression, the motor 52 does not experience the high torque condition, but will continue to function under a more constant load.

In order to compensate for tolerance build up, the illustrated latch 656 is provided with a longitudinal spring slot 667 near the rear end 663. The slot 667 has a width and length sufficient to receive the compression spring 686 therein when in an uncompressed, or slightly compressed state. The front finger 668 and the rear finger 677 extend into the slot 667 centered about the longitudinal axis 71. Fingers 668, 677 each have a width less than the inside diameter of the spring 686. Thus, fingers 668, 677 are received within the coils of spring 686 to secure the spring 686 within the latch slot 667 formed in latch 656. The front finger 668 extends a substantial distance into the slot 667. The front finger 668 is formed to include a longitudinal rod guide slot 684 centered on the longitudinal axis 71 of the latch 656. The rod guide slot 684 has a width greater than the diameter of the rod material from which actuator rod 62 is formed. Rod guide slot 684 has a length greater than the diameter of the material from which the actuator rod 62 is formed to permit the vertical leg 142 of the rod 62 to slide forwardly and rearwardly within the guide slot 684 to compensate for tolerance build up in the assembly.

In the illustrated embodiment, rod guide slot 684 has a length greater than the diameter of the material from which the actuator rod 62 is formed and the maximum expected tolerance build up. The vertical leg 142 of actuator rod 62 extends though the rod guide slot 684. Washers, having an inside diameter larger than the width of fingers 668, 677 and an outside diameter less than the width of spring slot 667 are received over the fingers 668, 677 to act as spring seats 679, 681 against which the ends of compression spring 686 seat, as show, for example, in FIGS. 33, 35. Compression spring 686 has a force constant great enough so that the spring 686 remains uncompressed during a large part of the movement of the latch 656 from the unlatched to the latch positions. Once the latch 656 is pulling against the door 26 with the force desired by the manufacturer (equal to the spring constant of the compression spring 686), further rearward translation of rod 62 induced by rotation of cam 54 causes vertical leg 142 of rod 62 to pull against spring seat 679 and compress spring 686 as the rod 62 slides rearwardly in rod slot 684, as shown, for example, in FIGS. 34, 35. Thus, motor 52 experiences no more torque than it is designed to experience when the door 26 is pulled-in against the oven frame 30.

Although the invention has been described in detail with reference to a certain preferred embodiment, variations and modifications exist within the scope and spirit of the present invention as described and defined in the following claims.

What is claimed is:

1. An oven lock mechanism for locking a door of a self-cleaning oven in a closed position, the oven having a front and a rear, the oven door being mounted on a frame surrounding an opening of an oven compartment and being movable between an open and a closed position, the oven lock mechanism comprising:

a mounting plate supported above the oven compartment, the mounting plate having a channel formed therein about an axis extending laterally relative to the front of the oven;

a latch adapted to engage the oven door and being movable between a first position in which the oven door may be opened and a second position in which the oven door may not be opened;

a pin extending from a fixed position on the latch, the pin extending through and being received for movement along the axis of the channel, the pin being configured to rotate within the channel facilitating rotation of the latch relative to the mounting plate from the first position to the second position;

a motor;

a rotor arm rotatably driven by the motor;

a rod secured to the rotor arm at a first end and secured to the latch at a second end, the rod acts to convert rotary movement of the rotor arm into translational and rotational movement of the latch and acts to guide the latch toward the second position during translational movement of the latch; and a directional positioner, located between the latch and the rotor arm, to induce the rod to urge the latch towards the second position as the motor rotates the rotor arm to move the latch from the first position to the second position.

2. The device of claim 1, the directional positioner being a guide located between the latch and the rotor arm, the rod riding against the guide to induce the rod to flex during rotation of the rotor arm to guide the latch toward the second position, and wherein upon rotation of the rotor arm by the motor, the rod translates, moving the latch between the first and second positions.

3. The device of claim 2 wherein the oven has a high temperature region adjacent the oven opening and lower temperature regions displaced from the oven opening and the motor is mounted in a lower temperature region.

4. The device of claim 2 wherein the rod is monolithic.

5. The device of claim 2 wherein the mounting plate extends from adjacent the front of the oven to beyond the rear wall of the oven compartment and the motor and rotor arm are mounted to the portion of the mounting plate extending beyond the rear wall.

6. The device of claim 5 wherein the mounting plate is monolithic.

7. The device of claim 6 wherein the rod is monolithic.

8. The device of claim 5 and further comprising a spring coupled between the rotor arm and latch to limit the maximum force the latch exerts on the door.

9. The device of claim 8 wherein the latch pushes against the spring to urge the spring to compress when the force exerted by the latch on the door exceeds a selected value.

10. A motorized door lock assembly for locking an oven door in a closed position so as to close an oven compartment for purposes of cleaning the oven compartment, the oven door being mounted on a range body, the door lock assembly comprising:

a latch having a hook at one end for engaging the oven door, the latch being mounted to the range body for rotation about a translatable pivot axis between an unlatched position wherein the hook does not inhibit movement of the oven door and a latched position wherein the hook does inhibit movement of the oven door and also being mounted for reciprocal translation with the pivot axis between a non-pulled-in position wherein the latch does not pull against the oven door and a pulled-in position wherein the latch pulls against the oven door;

a motor, a rotor arm rotatably driven by the motor, a linkage extending generally from a back to a front of the range body above the oven compartment, the linkage being secured to the rotor arm at one end and secured to the latch at the other end, upon rotation of the rotor arm by the motor, the linkage translates inducing rotation of the latch from the unlatched position to the latched position prior to translating the latch from the non-pulled-in to the pulled-in position; and a directional positioner, located between the latch and the rotor arm, to induce the rod to urge the latch towards the latched position as the motor rotates the rotor arm to move the latch from the unlatched position to the latched position.

11. The device of claim 10 and further comprising a pivot pin formed about the translatable pivot axis and a mounting plate supportable by the range body above the oven compartment, the mounting plate having a pivot guide cooperating with the pivot pin to guide reciprocal translational movement of the pivot axis.

12. The device of claim 11 wherein the pin extends through a slot in the mounting plate to restrict movement of the latch as the latch moves between the non-pulled-in and pulled-in positions.

13. The device of claim 12 wherein the latch is movable from the latched to the unlatched position so the oven door may be opened without translation of the latch.

14. The device of claim 12 wherein the detent force of the motor inhibits opening of the door when in the latched position and the pulled-in position.

15. An oven lock mechanism for use with an oven having a door at the front of the oven and a frame surrounding a cooking chamber having an opening at the front of the oven and a rear wall adjacent to a rear of the oven, the front opening of the cooking chamber being selectively closed by engagement of the door with the frame, the lock mechanism comprising:

a pivot pin having a pivot axis extending therethrough;

a mounting plate mounted to the frame and extending from the front to beyond the rear wall of the oven chamber, the mounting plate formed to include a pivot pin guide configured to guide reciprocal movement of the pivot pin received therein forwardly and rearwardly with respect to the mounting plate;

a latch mounted to the pivot pin for movement about the pivot axis and rotatable about the pivot axis between an unlatched position and latched position and mounted to the mounting plate for reciprocal movement with the pivot pin between a pulled-in position and a non-pulled-in position;

an electromechanical actuator mounted to the mounting plate, the actuator having a first state and a second state;

a linkage coupled between the latch and the actuator to move the latch from the unlatched and not pulled-in position when the actuator is in the first state to the latched and pulled-in position when the actuator is in the second state wherein the linkage induces rotation of the latch from the unlatched position to the latched position prior to inducing reciprocal movement of the latch; and a directional positioner, located between the latch and the rotor arm, to induce the linkage to urge the latch towards the latched state as the motor rotates the rotor arm to move the latch from the unlatched state to the latched state.

16. The device of claim 15 wherein the actuator is a motor.

17. The device of claim 16 and further comprising a cam mounted for rotation by the motor and a switch mounted to be engaged by the cam to provide a signal indicative of the state of the motor and wherein the linkage is coupled to the cam and the latch.

18. The device of claim 17 wherein the detent torque of the motor must be overcome to pull the door open when the latch is in the latched and pulled-in position.

19. The device of claim 16 wherein the mounting plate includes a front mounting plate portion coupled to a front of the frame adjacent the cooking compartment opening to which the latch is mounted and a rear mounting plate portion coupled to a rear of the oven to which the motor and cam are mounted.

20. The device of claim 19, the directional positioner being a guide is positioned relative to the mounting plate to flex the linkage to urge the latch to rotate prior to translating rearwardly and to translate forwardly prior to rotating.

* * * * *